US010995999B2

(12) United States Patent
Bultot et al.

(10) Patent No.: US 10,995,999 B2
(45) Date of Patent: May 4, 2021

(54) COOLING UNIT, INSTALLATION AND PROCESS

(71) Applicant: Hamon Thermal Europe S.A., Mont-St-Guibert (BE)

(72) Inventors: Thierry Bultot, Nivelles (BE); Romain Chevremont, Liège (BE); David Gilet, Walhain (BE); Trung Luu, Esneux (BE); Pascal Malpoix, Cortil-Noirmont (BE); Olivier Philippart, Ecaussinnes (BE); Hanno Reuter, Stellenbosch (ZA)

(73) Assignee: Hamon Thermal Europe S.A., Mont-st Guibert (BE)

( * ) Notice: Subject to any disclaimer, the term of this patent is extended or adjusted under 35 U.S.C. 154(b) by 219 days.

(21) Appl. No.: 15/913,727

(22) Filed: Mar. 6, 2018

(65) Prior Publication Data

US 2019/0128614 A1 May 2, 2019

(30) Foreign Application Priority Data

Oct. 31, 2017 (BE) ..... 2017/0151

(51) Int. Cl.
*F28B 1/06* (2006.01)
*F28D 1/04* (2006.01)
(Continued)

(52) U.S. Cl.
CPC ..... *F28D 7/1653* (2013.01); *F25B 39/00* (2013.01); *F28B 1/06* (2013.01); *F28D 1/0426* (2013.01);
(Continued)

(58) Field of Classification Search
CPC ..... F28B 1/06; F28D 1/0426; F28D 1/0443; F28D 1/05341; F28D 1/05391; F25B 39/00; F25B 39/04; F28F 2265/26; F28F 9/013
See application file for complete search history.

(56) References Cited

U.S. PATENT DOCUMENTS 2,195,887 A * 4/1940 Kotzebue ..... B01D 5/0012 165/67
3,204,613 A * 9/1965 Smith ..... F22B 37/201 122/510
(Continued)

FOREIGN PATENT DOCUMENTS

CN 203744806 U 7/2014
CN 203908349 U 10/2014
(Continued)

OTHER PUBLICATIONS

Search Report in Corresponding UK Application No. GB1805707.5 dated Sep. 6, 2018 (4 pages).
(Continued)

*Primary Examiner* — Leonard R Leo
(74) *Attorney, Agent, or Firm* — Hovey Williams LLP

(57) ABSTRACT

Cooling unit in which the first and second heat exchangers [13], [16] are suspended along one of their longitudinal edges respectively to one of the suspension pipes selected from first, second and third pipes, [10], [11], [12], and are capable of undergoing a substantially free elongation and/or expansion curvature below the level of the pipe suspension.

37 Claims, 8 Drawing Sheets

(51) Int. Cl.

| | |
|---|---|
| ***F28D 1/053*** | (2006.01) |
| ***F28F 9/013*** | (2006.01) |
| ***F28D 7/16*** | (2006.01) |
| ***F25B 39/00*** | (2006.01) |
| *F28D 1/02* | (2006.01) |
| *F25B 39/04* | (2006.01) |

(52) U.S. Cl.
CPC ..... *F28F 9/013* (2013.01); *F25B 39/04* (2013.01); *F28D 1/024* (2013.01); *F28D 1/0443* (2013.01); *F28D 1/05341* (2013.01); *F28D 1/05391* (2013.01); *F28F 2255/02* (2013.01); *F28F 2265/26* (2013.01); *F28F 2280/00* (2013.01)

(56) References Cited

U.S. PATENT DOCUMENTS

| | | | | |
|---|---|---|---|---|
| 3,814,177 | A | 6/1974 | Harris et al. | |
| 4,236,574 | A * | 12/1980 | Bosne | F28B 1/06 165/67 |
| 5,131,459 | A * | 7/1992 | Thompson | F22B 37/202 165/67 |
| 5,722,354 | A * | 3/1998 | Sansoucy | F22B 1/1815 165/67 |
| 8,833,082 | B2 * | 9/2014 | Borre | F28B 1/06 60/692 |
| 9,995,182 | B2 * | 6/2018 | Scholz | F01K 9/003 |
| 10,161,683 | B2 * | 12/2018 | Singh | F28B 1/06 |
| 2005/0161094 | A1 | 7/2005 | Schmidt | |
| 2014/0251589 | A1 | 9/2014 | Vouche et al. | |
| 2016/0102918 | A1 | 4/2016 | Badin et al. | |
| 2017/0363358 | A1 * | 12/2017 | Bugler, III | B66B 1/3453 |

FOREIGN PATENT DOCUMENTS

| | | | |
|---|---|---|---|
| DE | 1205563 | B | 11/1965 |
| DE | 1945314 | A1 | 3/1971 |
| DE | 202014104666 | U1 | 11/2014 |
| EP | 1616141 | B1 | 10/2006 |
| EP | 1642075 | B1 | 12/2006 |
| FR | 1249717 | A | 12/1960 |
| GB | 900179 | A | 7/1962 |
| NL | 2014379 | B1 | 10/2016 |
| WO | 2004094932 | A1 | 11/2004 |
| WO | 2010039416 | A1 | 4/2010 |
| WO | 2013181512 | A1 | 12/2013 |
| WO | 2017202730 | A1 | 11/2017 |

OTHER PUBLICATIONS

Search Report from Priority Belgian Patent Application No. 2017/0151 dated Nov. 18, 2017 (3 pages).

Hamon.com website Air cooled condensers dated Aug. 25, 2017 http://www.hamon.com/index/cms/age/air-cooled-condensers/lan/en (2 pages).

* cited by examiner

COOLING UNIT, INSTALLATION AND PROCESS

CROSS REFERENCE

The present application claims the benefit of Belgian patent application BE2017/0151 filed on Oct. 31, 2017.

BRIEF SUMMARY OF THE INVENTION

The subject of the present invention is a unit for cooling a first fluid by means of a second fluid not in direct contact with each other, said unit forming an integral assembly able to be displaced and mounted on a supporting structure and able to be connected or not to one or more other units to form a cooling system, said cooling unit comprising at least:

- one first metallic pipe with a first central axis,
- one second metallic pipe with a second central axis substantially parallel to said first central axis,
- one third metallic pipe, possibly with separate flow channels, said third metallic pipe having a third central axis substantially parallel to said first central axis and to said second central axis, said third pipe being distant from the first pipe and the second pipe by 2 m or more than 2 m,
- one first at least partially metallic heat exchanger extending between a first longitudinal edge adjacent to the first pipe and a second longitudinal edge adjacent to the third pipe, said first exchanger having an external side adapted to be in contact with said second fluid and defining an inner chamber (by inner chamber, we also understand a multitude of chambers directly communicating between them, or even a multitude of channels distinct from each other) communicating with said first pipe and said third pipe or the channel of the latter, allowing the first fluid to flow through said first metallic heat exchanger between said first pipe and said third pipe or the channel of the latter or the other way around,
- one second at least partially metallic heat exchanger extending between a first longitudinal edge adjacent to the second pipe and a second longitudinal edge adjacent to the third pipe, said heat exchanger having an outer side adapted to be in contact with said second fluid and defining an inner chamber in communication with said second pipe and said third pipe or the channel of the latter, allowing the first fluid to flow through said second metallic heat exchanger between the said second pipe and the said third pipe or the channel of the latter or the other way round.

THE STATE OF THE ART

By cooling unit, it is understood a unit for transferring calories from a first fluid to a second fluid. When the first fluid is condensable or partially condensable, the temperature of the first fluid remains substantially constant. When the second fluid contains air, the cooling of the first fluid will generate an increase in air temperature.

Many units cooling a first fluid with another fluid have been proposed. All these units are built on an existing structure with platforms and transverse elements. These units are therefore supported by the structure and are not of the suspended or removable type as such with respect to the structure.

In cooling units attached to an existing structure, a first fluid, in particular steam to be condensed (for example water to be condensed) is fed via a large distribution line to a series of heat exchangers, through which air is circulated. In existing installations, heat exchangers are carried by the structure, by bearing directly on elements of the structure, with, sometimes, integrated or integral support elements of the exchanger, said integrated support elements being lateral profiles or profiles defining a support frame, said profiles then being attached to the support structure.

Such systems are for instance described in EP1616141, EP1642075, DE1945314, US2016/0102918, WO2013/181512, etc. In all these known systems, heat exchangers are mounted directly on the load bearing or reinforcement structure resting on the ground. Moreover, this structure carries all the weight of the supply and distribution lines. The structures are thus large and have many profiles to take all the efforts generated when using such an installation. We can refer for example to US2016/0102918 or DE202014104666.

In existing installations, the heat exchangers may be reinforced to serve as elements of the structure carrying the distribution lines and/or collection lines.

As an example of commercialised systems, reference can be made to the systems of the applicant, which is described on the web page: http://www.hamon.com/index/cms/page/air-cooled-condensers/lang/en, viewed in August 2017.

The structures of the existing facilities require significant effort in terms of installation, and a lot of human work above ground, involving substantial safety measures. In addition, the control of almost all parts of the installations must be done above ground. The structure of these installations, which forms an entity with the heat exchangers, undergoes variable expansion efforts, which are transmitted throughout the structure, which will then involve more complex design calculations for the structure and/or involve more important safety factors. The fact that the structure is oversized will make its building even more complex and will be a source of additional costs.

Existing installations are not designed for construction as a kit, or dismountable construction or mounting at ground level with preassembled elements, particularly in workshop.

BRIEF DESCRIPTION OF THE INVENTION

The present invention relates to an installation whose elements can be preassembled at ground level and then be suspended from an existing structure. The supporting structure can thus for example be sized by taking into account only the weight of units or platforms to be carried, without having to take into consideration the dilation efforts of the suspended units or platforms carried by the structure, in particular carried by the suspended units. This makes it possible to to reduce the size of the supporting structure and/or to reduce the bulk of the structure at ground level or near the ground.

The invention also relates to a cooling installation that can be in the form of modules that can easily be mounted on each other or dismounted. The cooling units can be assembled near the ground level at the selected site for the supporting structure, and thereafter lifted for suspending them on the said supporting structure.

A main object of the invention is a unit of the type described in the first paragraph of the present patent specification, said unit being mainly characterized:

in that said unit is adapted to ensure that the first and the second heat exchangers are suspended along one of their longitudinal edges respectively to one of the suspension pipes chosen among said first, second and third pipes, and that they are capable of being submitted to, below the level of the suspension pipe, an elongation and/or a substantially free expansion curvature, and in that said suspension pipe(s) are attached to the first metal heat exchanger and/or to the second metal heat exchanger by means able to take up at least substantially all of the traction force generated by the weight of the heat exchanger under consideration on the suspension pipe of the heat exchanger in question.

According to the invention, the unit allows to cool, especially to condensate at least partially, the first fluid, for example to condensate vapor at 70% to 95% of the volume.

In the present patent specification, at least 1 means 1 and more than 1, for example 1, 2, 3, 4, 5, 6, etc. In general, at least one integer X means X, X+1, X+2, X+3, X+4, and so on. "At least one non-integer Y" means said non-integer number Y and any integer or non-integer greater than Y. At most a non-integer Z designates said non-integer number Z and any non-integer or integer number of less than Z.

The cooling unit of the invention is among other a cooling unit [1] for the cooling or at least partial condensation of a first fluid [F1] by means of a second fluid [F2] not in direct contact with each other, said unit [1] forming an integral assembly adapted to be moved and mounted on a supporting structure, said cooling unit [1] comprising at least:

one first metallic pipe [10] with a first central axis [A10], one second metallic pipe [11] with a second central axis [A11] substantially parallel to said first central axis [A10], one third metallic pipe [12] [possibly with separate flow channels], said third metallic pipe [12] having a third central axis [A12] substantially parallel to said first central axis [A10] and to said second central axis [A11], said third pipe [12] being distant from the first pipe and the second pipe by a distance of at least 2 meters, one first at least partially metallic heat exchanger [13] having a first longitudinal edge [14] and a second longitudinal edge [15] opposite to said first longitudinal edge [14] and being distant from said first longitudinal edge [14] of said first at least partially metallic heat exchanger [13], said first longitudinal edge [14] of said first at least partially metallic heat exchanger [13] extending adjacent to the first pipe [10], while the said second longitudinal edge [15] of said first at least partially metallic heat exchanger [13] extends adjacent to the third metallic pipe [12], said first at least partially metallic heat exchanger [13] having an external side adapted to be in contact with said second fluid [F2] and defining an inner chamber communicating with said first metallic pipe [10] and said third metallic pipe [12], allowing the first fluid [F1] to flow through said inner chamber of said first at least partially metallic heat exchanger [13] for directing the first fluid according to a flow selected from the group consisting of a first flow for directing the first fluid from said first metallic pipe [10] towards said third metallic pipe [12] through at least a first portion of the said inner chamber of said first at least partially metallic heat exchanger [13], a second flow for directing the first fluid from said third metallic pipe [12] towards said first metallic pipe [10] through at least a second portion of the said inner chamber of said first at least partially metallic heat exchanger [13], and combinations thereof, one second at least partially metallic heat exchanger [16] having a first longitudinal edge [17] and a second longitudinal edge [18] opposite to the said first longitudinal edge [17] of the second at least partially metallic heat exchanger [16], said first longitudinal edge [17] of the second at least partially metallic heat exchanger [16] extending adjacent to the second metallic pipe [11], while the said second longitudinal edge [18] of the second at least partially metallic heat exchanger [16] extends adjacent to the third metallic pipe [12], said second at least partially metallic heat exchanger [16] having an external side adapted to be in contact with said second fluid [F2] and defining an inner chamber communicating with the said second metallic pipe [11] and the said third metallic pipe [12], allowing the first fluid [F1] to flow through said inner chamber of said second at least partially metallic heat exchanger [16] according to a flow selected from the group consisting of a first flow for directing the first fluid [F1] from said second metallic pipe [11] towards said third metallic pipe [12] through at least a first portion of the said inner chamber of said second at least partially metallic heat exchanger [16], a second flow for directing the first fluid [F1] from said third metallic pipe [12] towards said second metallic pipe [11] through at least a second portion of the said inner chamber of said second at least partially metallic heat exchanger [16], and combinations thereof, Whereby said cooling unit [1] is adapted to ensure:

(i) that the first at least partially metallic heat exchanger [13] is suspended to one metallic suspension pipe selected from the group consisting of the first metallic pipe [10] and the third metallic pipe [12] along one of the first longitudinal edge [14] and the second longitudinal edge [15] of the said first at least partially metallic heat exchanger [13], whereby the said first at least partially metallic heat exchanger [13] is suspended at a level below the said one metallic suspension pipe selected from the group consisting of the first metallic pipe [10] and the third metallic pipe [12], and is capable of being submitted to an expansion below the said one metallic suspension pipe of the first at least partially metallic heat exchanger [13] selected among the group consisting of substantially free elongation, substantially free expansion curvature and combinations thereof, and (ii) that the second at least partially metallic heat exchanger [16] is suspended to one metallic suspension pipe selected from the group consisting of the second metallic pipe [11] and the third metallic pipe [12] along one of the first longitudinal edge and the second longitudinal edge of the said second at least partially metallic heat exchanger [16], whereby the said second at least partially metallic heat exchanger [16] is suspended at a level below the said one metallic suspension pipe selected from the group consisting of the second metallic pipe [11] and the third metallic pipe [12], and is capable of being submitted to an expansion below the said one metallic suspension pipe of the second at least partially metallic heat exchanger [16], said expansion being selected among the group consisting of substantially free elongation, substantially free expansion curvature and combinations thereof;

whereby the first at least partially metallic heat exchanger [13] has a weight generating a traction force on the said one metallic suspension pipe selected from the group consisting of the first metallic pipe [10] and the third metallic pipe [12], the said first at least partially metallic heat exchanger [13] being attached to the said one metallic suspension pipe selected from the group consisting of the first metallic pipe [10] and the third metallic pipe [12] by at least a means able to bear at least substantially totally the traction force generated by the weight of the first at least partially metallic heat exchanger [13], and whereby the second at least partially metallic heat exchanger [16] has a weight generating a traction force on the said one metallic suspension pipe selected from the group consisting of the second metallic pipe [11] and the third metallic pipe [12], the said second at least partially metallic heat exchanger [16] being attached to the said one metallic suspension pipe selected from the group consisting of the second metallic pipe [11] and the third metallic pipe [12] by at least a means able to bear at least substantially totally the traction force generated by the weight of the second at least partially metallic heat exchanger [16].

Advantageous embodiments of unit according to the invention may present one or more of the following features or details, particularly a combination thereof:

said suspension pipe(s) is (are) attached to the first metal heat exchanger and/or to the second metal heat exchanger by means capable of bearing at least substantially all of the traction force generated by the weight of the heat exchanger in question filled with said first fluid on the suspension pipe of the heat exchanger in question. This makes it possible to have a unit forming an assembly that can be moved, for example by lifting means. The assembly then conveniently features hanging systems or loop hooks for the hooks of one or more lifting gear(s). These hanging systems are advantageously secured to one or several suspension pipes.

said suspension pipe(s) is (are) attached to the first metal heat exchanger and/or the second metal heat exchanger by means capable of bearing at least 1.1, advantageously at least 1.2, advantageously 1.5 times the effort of maximum traction generated by the weight of the heat exchanger in question filled with said first fluid (totally or partially in the form of vapor and partially liquid or almost completely liquid, for example in a form at 70 to 95% by volume in vapor form under a pressure of 5 $10^5$ Pa and 5 to 30% by volume in liquid form) on the suspension pipe of the heat exchanger under consideration. For embodiments intended for the partial condensation of aqueous fluids or of water vapor, the weight of the fluid will be taken into account by taking into consideration a part of the first fluid (70 to 95% of the volume) in the form of pressurized vapor (e.g. 5-10 $10^5$ Pa) and another portion of the first fluid in liquid form.

The unit is adapted for a first fluid which is an at least partly condensable vapour, so as to ensure the at least partial condensation of said at partly condensable vapour in the form of a medium selected from the group consisting of (i) a liquid medium issued from the condensation of said at least partly condensable vapour, and (ii) medium mixtures comprising a first part in the form of a liquid medium issued from the condensation of said at least partly condensable vapour and a second part in the form of an at least partly condensable vapour, whereby the first at least partially metallic heat exchanger [13] having its inner chamber filled with at most 30% in volume (such as 5 to 30%, or 5 to 20% in volume) by the liquid medium issued from the condensation of said at least partly condensable vapour and with at least 70% in volume (such as from 70 to 95%, preferably from 80 to 95% by volume) by the at least partly condensable vapour has a weight generating a traction force on the said one metallic suspension pipe selected from the group consisting of the first metallic pipe [10] and the third metallic pipe [12], the said first at least partially metallic heat exchanger [13] being attached to the said one metallic suspension pipe selected from the group consisting of the first metallic pipe [10] and the third metallic pipe [12] by at least a means able to bear at least substantially totally the traction force generated by the weight of the first at least partially metallic heat exchanger [13] having its inner chamber filled with at most 30% in volume (such as 30% or a figure between 5 to 30% in volume) by the liquid medium issued from the condensation of said at least partly condensable vapour and with at least 70% (such as 70% or a figure between 70 and 95% in volume) in volume by the at least partly condensable vapour, and whereby the second at least partially metallic heat exchanger [16] having its inner chamber filled with at most 30% in volume by the liquid medium issued from the condensation of said at least partly condensable vapour and with at least 70% in volume by the at least partly condensable vapour has a weight generating a traction force on the said one metallic suspension pipe selected from the group consisting of the second metallic pipe [11] and the third metallic pipe [12], the said second at least partially metallic heat exchanger [16] being attached to the said one metallic suspension pipe selected from the group consisting of the second metallic pipe [11] and the third metallic pipe [12] by at least a means able to bear at least substantially totally the traction force generated by the weight of the second at least partially metallic heat exchanger [16] having its inner chamber filled with at most 30% in volume (such as 30%, or a figure between 5% and 30% in volume) by the liquid medium issued from the condensation of said at least partly condensable vapour and with at least 70% (such as 70% or a figure comprised between 70 and 95%) in volume by the at least partly condensable vapour.

it comprises at least two separate means for at least ensuring a spacing ranging from a minimum spacing to a maximum spacing between the first metallic pipe and the second metallic pipe. These distinct means contribute to the strengthening of the whole as such.

the suspension pipe(s) is (are) adapted to each take up at least 50% of the weight of a platform with fan supported on two adjacent suspension pipes. The pipe(s) or is (are) advantageously adapted to resist crushing by the weight of one or platforms with fan(s). Usefully, the connection between a platform and the suspension pipes is adapted to allow disassembly, as well as relative movements, for example in case of different dilation movements between the suspension pipe(s) and the platform(s).

it comprises two suspension pipes, while the third pipe is multi-channel or comprises two adjacent conduits, advantageously in communication with one another.

one of the suspension pipe(s) present(s), on at least one of their extremities, a movable or extensible connection relative to the suspension pipe considered adapted to take up the free space between the suspension pipe in question and an adjacent suspension pipe of another unit. Such connections are useful to leave a space between the adjacent units of which the pipe must be connected with one another, this spacing being necessary for the placement or the removal of a neighbouring unit without damages.

The unit is adapted for the cooling and condensation, at least partially, of a first fluid, in said first and second heat exchangers, the suspension pipes being supply pipes for the first fluid to be condensed at least partially (for example vapor like steam), while the pipes are pipes to collect the first fluid at least partially condensed, said pipes having a flow cross-section not more than ten times less than the flow cross-section of the supply pipes. The second fluid is for example air passing through heat exchangers in which the first fluid is condensed, at least partially, and advantageously only partially.

it has (as an independent unit) a center of gravity extending in a median plane between the first central axis and the second central axis, and passing through said third central axis, the center of gravity in question being slightly offset relative to both side ends of the unit. This makes it possible to position one end of one or several suspension pipes facing one or more ends of suspension pipes of another unit, before positioning the other end(s) relative to the structure, before connecting the adjacent ends of the suspension pipes of two adjacent units.

the unit has one or more suspension pipes extended towards the bottom by a supply pipe section each acting as support leg when the unit rests on the ground.

one or several or all said first, second and third metallic pipes can be associated with a longitudinal expansion compensator. Such an expansion compensator can be located at the level of a connector for connecting one suspension pipe to another.

heat exchangers can be associated with an expansion compensator. Such compensator(s) are notably used to limit the efforts at the level of the connection points/zones between two heat exchangers of the same unit.

one or several or all of said first, second and third metallic pipes can be associated with a connection device to connect to another pipe, the device in question can possibly comprise a valve.

the unit is in the form of a substantially longitudinal assembly with two longitudinal faces sloping between them defined by the faces (advantageously perforated) of heat exchangers, at least one lateral end side of the unit being closed by a side wall or a partition wall (at least partial), the side wall or partitioning wall in question is advantageously associated with a door. The third pipe advantageously extends to the junction of the sloping longitudinal faces and is optionally, but advantageously, associated with a walkway. The sidewalls or partition walls of adjacent units can define separate cells for induced or forced separate airflows.

the suspension pipe(s) can present one or several longitudinal reinforcements [35], which can present one or several passages that can be used as point(s) to attach or anchor to lifting systems, like lifting bars, for example.

in working or mounting position in an installation, the suspension or distribution pipe(s) are advantageously substantially horizontal, or even slightly inclined.

the suspension pipes are pipes to distribute the first fluid in the heat exchangers, the ends of each suspension pipe being adapted to be connected via an intermediate piece to a substantially vertical supply pipe, allowing the supply of each suspension pipe through its two ends, or through a specific end when using one or several valves.

a combination of such particulars and details.

Another purpose of the present invention is an installation for the cooling or condensation (at least partial, advantageously partial) of a first fluid (for example an at least partially condensable first fluid, at least to partially cool down or to condensate steam for example) by a second fluid (for instance water sprayed on one face of the exchanger, or air, or an air-water mixture), the system in question comprising at least one supporting structure intended to carry or support at least one series of cooling and/or condensation units according to the invention and advantageously connected together at least for the supply of the first fluid to different first and second heat exchangers, the pipe or suspension pipes being supported by the support structure, while heat exchangers are suspended from or carried by the suspension pipe(s).

In particular, an installation of the invention is an installation for the cooling, as well as the at least partial condensation of a first at least partly condensable fluid by means of a second fluid not in direct contact with the first at least partly condensable fluid, said installation comprising at least one supporting structure designed to carry at least one series of cooling units for the cooling, as well at least partial condensation of the said first at least partly condensable fluid, whereby said at least one series of cooling units are connected between them and to feeding system for the feeding of the first at least partly condensable fluid to said at least one series of cooling units, Whereby the units of said at least one series of cooling units are each a cooling unit [1] forming an integral assembly adapted to be moved and mounted on the supporting structure, said cooling unit [1] comprising at least:

one first metallic pipe [10] with a first central axis [A10], one second metallic pipe [11] with a second central axis [A11] substantially parallel to said first central axis [A10], one third metallic pipe [12] [possibly with separate flow channels], said third metallic pipe [12] having a third central axis [A12] substantially parallel to said first central axis [A10] and to said second central axis [A11], said third pipe [12] being distant from the first pipe and the second pipe by a distance of at least 2 meters, one first at least partially metallic heat exchanger [13] having a first longitudinal edge [14] and a second longitudinal edge [15] opposite to said first longitudinal edge [14] and being distant from said first longitudinal edge [14] of said first at least partially metallic heat exchanger [13], said first longitudinal edge [14] of said first at least partially metallic heat exchanger [13] extending adjacent to the first pipe [10], while the said second longitudinal edge [15] of said first at least partially metallic heat exchanger [13] extends adjacent to the third metallic pipe [12], said first at least partially metallic heat exchanger [13] having an external side adapted to be in contact with said second fluid [F2] and defining an inner chamber communicating with said first metallic pipe [10] and said third metallic pipe [12], allowing the first fluid [F1] to flow through said inner chamber of said first at least partially metallic heat exchanger [13] for directing the first fluid according to a flow selected from the group consisting of a first flow for directing the first fluid from said first metallic pipe [10] towards said third metallic pipe [12] through at least a first portion of the said inner chamber of said first at least partially metallic heat exchanger [13], a second flow for directing the first fluid from said third metallic pipe [12] towards said first metallic pipe [10] through at least a second portion of the said inner chamber of said first at least partially metallic heat exchanger [13], and combinations thereof, one second at least partially metallic heat exchanger [16] having a first longitudinal edge [17] and a second longitudinal edge [18] opposite to the said first longitudinal edge [17] of the second at least partially metallic heat exchanger [16], said first longitudinal edge [17] of the second at least partially metallic heat exchanger [16] extending adjacent to the second metallic pipe [11], while the said second longitudinal edge [18] of the second at least partially metallic heat exchanger [16] extends adjacent to the third metallic pipe [12], said second at least partially metallic heat exchanger [16] having an external side adapted to be in contact with said second fluid [F2] and defining an inner chamber communicating with the said second metallic pipe [11] and the said third metallic pipe [12], allowing the first fluid [F1] to flow through said inner chamber of said second at least partially metallic heat exchanger [16] according to a flow selected from the group consisting of a first flow for directing the first fluid [F1] from said second metallic pipe [11] towards said third metallic pipe [12] through at least a first portion of the said inner chamber of said second at least partially metallic heat exchanger [16], a second flow for directing the first fluid [F1] from said third metallic pipe [12] towards said second metallic pipe [11] through at least a second portion of the said inner chamber of said second at least partially metallic heat exchanger [16], and combinations thereof, Whereby each of said cooling unit [1] forming an integral assembly adapted to be moved and mounted on the supporting structure is adapted to ensure:

(i) that the first at least partially metallic heat exchanger [13] is suspended to one metallic suspension pipe bearing on the supporting structure, said one metallic suspension pipe being selected from the group consisting of the first metallic pipe [10] and the third metallic pipe [12] along one of the first longitudinal edge [14] and the second longitudinal edge [15] of the said first at least partially metallic heat exchanger [13], whereby the said first at least partially metallic heat exchanger [13] is suspended at a level below the said one metallic suspension pipe selected from the group consisting of the first metallic pipe [10] and the third metallic pipe [12], and is capable of being submitted to an expansion below the said one metallic suspension pipe of the first at least partially metallic heat exchanger [13] selected among the group consisting of substantially free elongation, substantially free expansion curvature and combinations thereof, and (ii) that the second at least partially metallic heat exchanger [16] is suspended to one metallic suspension pipe bearing on the supporting structure and being selected from the group consisting of the second metallic pipe [11] and the third metallic pipe [12] along one of the first longitudinal edge and the second longitudinal edge of the said second at least partially metallic heat exchanger [16], whereby the said second at least partially metallic heat exchanger [16] is suspended at a level below the said one metallic suspension pipe selected from the group consisting of the second metallic pipe [11] and the third metallic pipe [12], and is capable of being submitted to an expansion below the said one metallic suspension pipe of the second at least partially metallic heat exchanger [16], said expansion being selected among the group consisting of substantially free elongation, substantially free expansion curvature and combinations thereof;

whereby the first at least partially metallic heat exchanger [13] has a weight generating a traction force on the said one metallic suspension pipe selected from the group consisting of the first metallic pipe [10] and the third metallic pipe [12], the said first at least partially metallic heat exchanger [13] being attached to the said one metallic suspension pipe selected from the group consisting of the first metallic pipe [10] and the third metallic pipe [12] by at least a means able to bear at least substantially totally the traction force generated by the weight of the first at least partially metallic heat exchanger [13], and whereby the second at least partially metallic heat exchanger [16] has a weight generating a traction force on the said one metallic suspension pipe selected from the group consisting of the second metallic pipe [11] and the third metallic pipe [12], the said second at least partially metallic heat exchanger [16] being attached to the said one metallic suspension pipe selected from the group consisting of the second metallic pipe [11] and the third metallic pipe [12] by at least a means able to bear at least substantially totally the traction force generated by the weight of the second at least partially metallic heat exchanger [16].

An installation of the invention advantageously presents one or more details/characteristics of units according to the invention as disclosed in the present specification, and/or one or more of the following specific details/characteristics:

the supporting structure comprises one or several pipes, one or more substantially vertical pipe(s) associated in their upper section with a connection piece with at least one suspension pipe of a unit according to the invention, said substantially vertical pipe advantageously serving as a supporting structure for at least part of the unit considered.

the installation comprises a series of units according to the invention, the suspension pipe(s) of which are each associated with at least two substantially vertical pipes with the interposition of a connecting piece, these at least two substantially vertical pipes serving as supporting structure of at least a part of the considered unit, advantageously only a part of the considered unit. According to a possible embodiment type, each suspension pipe of a unit is suspended on three elements, namely two substantially vertical pipes to cool down the first fluid and an intermediate column supporting a central zone of the suspension pipe in question. According to another possible embodiment, two distinct columns, separated from the supporting structure, carry the suspension pipe of units according to the invention.

the installation is used for the condensation, at least partial, advantageously only partial, of a first fluid in a partially condensed or at least partially condensed first fluid using a second fluid in contact with the heat exchangers. It comprises a network of pipes for the supply of the first fluid to be condensed partially or at least partially at a level located under the lower level of the heat exchangers of the different units, a series of substantially vertical pipes connected to the pipes of the units in question, and advantageously a network to collect the first condensed or partially condensed fluid from the heat exchangers.

said substantially vertical pipes (advantageously supply pipes) present one or more vertical and/or horizontal reinforcements, advantageously at least substantially vertical, preferably located at least outside the substantially vertical pipes, said reinforcements forming exchange areas extending outside the outer surface of the substantially vertical supply pipe(s). Such vertical pipes are used advantageously, at least partially, to support an extremity of a suspension pipe.

When the vertical pipe is extended via a bend to a substantially horizontal vapor distribution pipe at the top of a heat exchanger assembly, one or more reinforcements extends advantageously at least in the vicinity of the bend between the vertical pipe and the horizontal pipe.

When the substantially vertical supply pipe comprises one or more substantially vertical reinforcement(s) and when the substantially horizontal distribution pipe presents one or more horizontal reinforcement(s), one or more sloping reinforcement(s) extends advantageously between one or more vertical reinforcement(s) and one or more horizontal reinforcements.

According to one type of embodiment, the substantially vertical supply pipe presents a section extending at an upper level of the substantially horizontal distribution pipe, and one or more sloping reinforcement(s) where a plane extends advantageously between one or more vertical reinforcement(s) of the vertical pipe and one or more horizontal reinforcement(s) of the distribution or suspension pipe.

To ensure a better effort distribution, there are one or more ring(s) or flanges connecting the reinforcements between each other, for example in the vicinity of their free end.

said at least two substantially vertical supply pipes have a substantially circular flow cross-section, while the ratio 4 times the internal volume of a pipe/external surface of the pipe in question with external reinforcement(s) is less than the diameter of the substantially vertical pipe in question, advantageously less than 0.9 times (for instance less than 0.8 times, preferably less than 0.7 times) said equivalent internal diameter. The internal equivalent diameter for a pipe comprising fins or reinforcements extending in the interior passage of the pipe is equal to 4 times the internal cross-section flow (cross-section perpendicular to the central axis) divided by the perimeter of said flow cross-section.

the system comprises at least two substantially vertical pipes connected together by at least one unit according to the invention with possible interposition of one or more intermediate elements (for example provided with an isolation or flow control valve) or by an element to which is attached a heat exchanger assembly.

said at least two substantially vertical supply pipes form the posts of a structure carrying the unit according to the invention, and advantageously one or more fans adapted to generate an induced and/or forced air draft contacting or passing through the heat exchangers, in particular passing through the heat exchangers, at least partially.

they comprise a series of platforms that are associated or which can be associated with one or more fan(s) (advantageously removable), each of the said platforms resting between at least two suspension pipes of one or more units according to the invention.

the fans are adapted to generate an induced and/or forced air draft affecting the heat exchangers, in particular passing through at least partially the heat exchangers.

the vertical columns are fed near their base in first fluid.

the vertical columns are associated at their base with an expansion compensator, for instance to make sure that the suspension pipe(s) of one or more unit(s) remain substantially horizontal.

the installation may comprise one or more means for generating a natural air draft through the heat exchangers.

it comprises a network for the distribution of the first fluid extending at ground level or close to the ground level and connected to a series of supply and supporting pipes for the units according to the invention.

The distribution network advantageously comprises diverting valves and/or pipes to insulate from the distribution network one or more units according to the invention.

The distribution network comprises one or more mean(s) to absorb expansion movements, at least partially.

the installation advantageously comprises a network collecting the first fluid after its passage, its condensation in the heat exchangers.

This network comprises a series of down pipes each associated with one or more drains for the first fluid outside the exchangers, especially the condensers. The down pipes are advantageously associated with said drains via an intermediary element, able to compensate for a distortion, particularly an expansion joint. This network is then advantageously connected with a collection basin or reservoir. The down pipes cannot be used advantageously to support exchangers.

it appears in an at least partially removable form. Dismountable or removable elements, for example to allow the exchange of a defective element by another or to allow the repair of a defective element at ground level, are for example, the units according to the invention, the platforms with fan(s) (removable or not), the platforms and the fans.

The installation according to the invention can thus appear in the form of a series of modules, pre-mounted and welded to the ground (or close to the ground, for example on an intermediary support structure), on the site of the building site, or in a factory. The modules can thus be pre-tested (for example to check their tightness) before assembly. Pre-assembly on the ground can be done on a temporary supporting structure. When all the welds have been made for a unit, the unit can be tested, lifted from the temporary bearing structure, and installed at its final location. The unit can be reinforced with strengthening elements, temporarily or not, advantageously temporary, during its lifting and its installation on the structure.

The eventual temporary structure will be advantageously mobile, to ensure that the pre-assembly of a unit is in the neighborhood of a crane for the final placement of the unit within the structure. The installation thus takes the form of a series of modules ready to be lifted and installed on their final location and to be connected to each other or to the first fluid distribution network.

the supply pipes are associated at their base with a device allowing their connection to a source of vapour in different directions. This makes it possible to connect separate modules in different directions, and then makes it possible to best adapt to the free space or the configuration of the free space for the placement of modules. The installation can thus possibly comprise units located at locations distant from each other, although receiving the first fluid (for instance for partial condensation) via a same distribution circuit, in particular via the same supply pipe located near the ground level.

the installation comprises one or more means for associating it with one or more other units according to the invention or even to heat exchanger units, not according to the invention.

at least one or more of said supply pipes can be associated with a vertical compensator element capable of at least partly compensate for the vertical expansion of one or more substantially vertical supply pipes or the relative expansion between said substantially vertical supply pipes. In some configurations, this allows to maintain, if necessary, a substantially horizontal position of the vapor distribution pipes.

the vertical compensator element is associated with the lower part of one or more substantially vertical supply pipes.

the vertical compensator element comprises a device to collect condensates of vapours coming from the substantially vertical pipe, said collecting device being preferably adapted to bring the liquid condensates or condensation product of the vapour into a zone that's less in contact with the vapors.

the collecting device is associated with a system to evacuate the liquid possibly collected, advantageously a device with an overflow system.

The substantially horizontal distribution pipe can be slightly inclined in order for the liquids that could possibly be present in the distribution pipe to flow either in the exchanger assembly or to the vertical pipe and to the collecting device.

the compensator element has one or more closable openings designed to be associated with a pipe to another cooling system according to the invention or to a compensator element of another cooling system according to the invention said vertical supply pipe or said at least two substantially vertical supply pipes can be associated along their inner surface with one or more substantially vertical fins serving as internal reinforcement. Such internal reinforcements may for example be I-beams welded to the inner wall of the pipe, possibly with one or more rails extending between diametrically opposite beams relative to the central axis of the pipe.

said at least two substantially vertical pipes may be associated along their outer surface with one or more fins for external reinforcement, said substantially vertical fins being perforated with a perforation rate of more than 25%, for example 40%, of 50% or more. This reduces the weight of the reinforced pipes. The diametrically opposed fins are for example advantageously interconnected by plates, advantageously forming a cross, for example of the saltire type.

said at least two substantially vertical pipes may be adapted to also at least partially bear the weight of a structure associated with at least one fan adapted to generate a stream of air contacting the heat exchanger assembly(ies).

the fan or the structure bearing the fan can be associated with an air guiding device with an opening facing the substantially vertical pipe(s).

a combination of one or several of such characteristics.

The invention also relates to an installation that comprises cooling or condensing units (at least partial, advantageously only partially) of an at least partially condensable first fluid, advantageously to be at least partially condensed, the installation comprising heat exchangers with large-size front surface, each of which is at least 50% (for instance at least 75%, at least 80%, or even all) of their weight filled with first fluid (in vapor or partially condensed form, or in case of a liquid first fluid, in liquid form) by one or more supply pipes and/or one or more evacuation or collecting pipe(s). This will then reduce the necessary size of support structures with beams and profiles. This also makes it possible to support the platforms with fan(s) on a structure that is less subject to the forces generated in heat exchangers and pipes. In one possible embodiment, the installation comprises two independent structures, a first bearing the platforms with fan(s), and a second bearing or supporting the heat exchangers.

This installation can comprise 2 or more than 2 supply substantially vertical pipes, and 1 or more than 1 substantially vertical condensed vapor evacuation pipe(s) in the exchanger unit, said supply and evacuation pipes substantially bearing all the weight of the heat exchanger and being advantageously mounted on a support base or support structure. In this case, the substantially vertical evacuation pipes are advantageously associated to one or more reinforcement (s), especially vertical, which can advantageously be associated between them through reinforcement pipes and which can be used to bear a platform onto which a fan is mounted. Furthermore, the installation can comprise 1 or more than 1 substantially vertical supply pipe(s) and 2 or more than 2 (for instance 4, 6, 8, etc.) substantially vertical condensed vapor evacuation pipes for each heat exchanger unit, said supply and evacuation pipes bearing all the weight of the heat exchanger and being advantageously mounted on a support base or support structure.

This other installation according to the invention can comprise one or several details or characteristics of the installation according to the invention previously described.

Another subject of the invention is the use of an installation according to the invention for cooling, in particular for partially or at least partially condensing a first fluid by means of a second fluid, particularly air (optionally with liquid water supply).

The process according to the invention is thus a cooling or condensation process (at least partially, for example at 70 to 95% of the vapor volume entering in each heat exchanger) of a first fluid using a second fluid, in an installation according to the invention, in which the first fluid is supplied to the heat exchangers of units according to the invention, and wherein said heat exchangers are being put in contact with a second fluid (for instance air, moist air, water, air-water mixture).

The first fluid flows inside the heat exchangers, while the second fluid flows outside the heat exchangers.

In the installations according to the invention, each fan is advantageously mounted in such a way that it can be removed from its platform, which is also advantageously mounted in such a way that it can be removed from the suspension pipes of units according to the invention.

In this process, an installation is advantageously used, which comprises platforms associated with one or more motor-fan groups bearing on two suspension pipes. In this process, when a major problem is detected or a heavy or major maintenance must be performed in one or more motor-fan group(s) of a platform or in a unit according to the invention, the defective motor-fan group(s) and/or the platform with the motor-fan group(s) with a major problem to replace it (them) by one or more new motor-fan group(s) or one or more motor-fan group(s) in working condition and/or a platform with motor-fan group(s) in working condition or to move it at ground level for its repair, before its mounting back on the platform and/or before the positioning of the platform to bear on the two suspension pipes of one or more unit(s) according to the invention, and/or after having lifted the motor-fan group(s) and/or one or more platforms with motor-fan group(s) bearing on one or more suspension pipes, the unit presenting a major problem or requiring a major maintenance is lifted for replacing it with another unit and/or to move it at ground level or at the level of a temporary and/or mobile supporting structure for its maintenance or its repair before its replacement, and the platform(s) is (are) replaced back with or without motor-fan group(s) so it (they) can bear on at least one of the suspension pipes of the replaced or repaired unit, and a motor-fan group is placed back on the platform that has been placed back in place, if the fan was removed on this or these platform(s).

In this process, the replacement can be made quickly, after having interrupted the operation of the installation, even partially. Preferably, however, the installation may comprise means adapted to isolate one or more unit(s) according to the invention, so as to be able to carry out maintenance work or even replace parts associated with a unit or units without having to stop the operation of the entire installation according to the invention. To isolate one or more units, it is possible to close one or more valves of a distribution network, and/or to transfer part of the first fluid to other units by means of bypass pipes.

The subject of the invention is also a method for building an installation following the invention, comprising at least the following steps:

building a supporting structure on a chosen site (this step is often followed by a step including the control or the reception of the bearing structure, before mounting on the latter the unit according to the invention);

building at ground level or close to this level, close to the site or the supporting structure, of a series of units according to the invention, or transport of units according to the invention close to the site or to the supporting structure (when the units are built close to the supporting structure, a temporary and/or intermediary supporting structure, advantageously mobile, can be used, so that the units can be built close to their location in the supporting structure of the installation);

optionally, but advantageously, checking one or several parameters, for instance the tightness of one or more unit(s) built or brought to and/or to be brought to the site;

lifting the units to place them on the supporting structure, so that the units can bear on the supporting structure, in order to be suspended via their suspension pipe(s).

The platforms with or without their motor-fan group can also be assembled at ground level or in the workshop before being mounted in one piece in the installation according to the invention. It is also possible to first mount one or more platform(s) without fan, and to mount fans on platforms only later.

Features and details of embodiments according to the invention given by way of example only will be apparent from the following detailed description in which reference is made to the attached figures.

BRIEF DESCRIPTION OF THE DRAWINGS

In these figures,

FIG. 3 is a front view of part of an installation comprising a series of units according to FIG. 2;

DESCRIPTION OF EXAMPLES OF PREFERRED EMBODIMENTS

Figure 1:
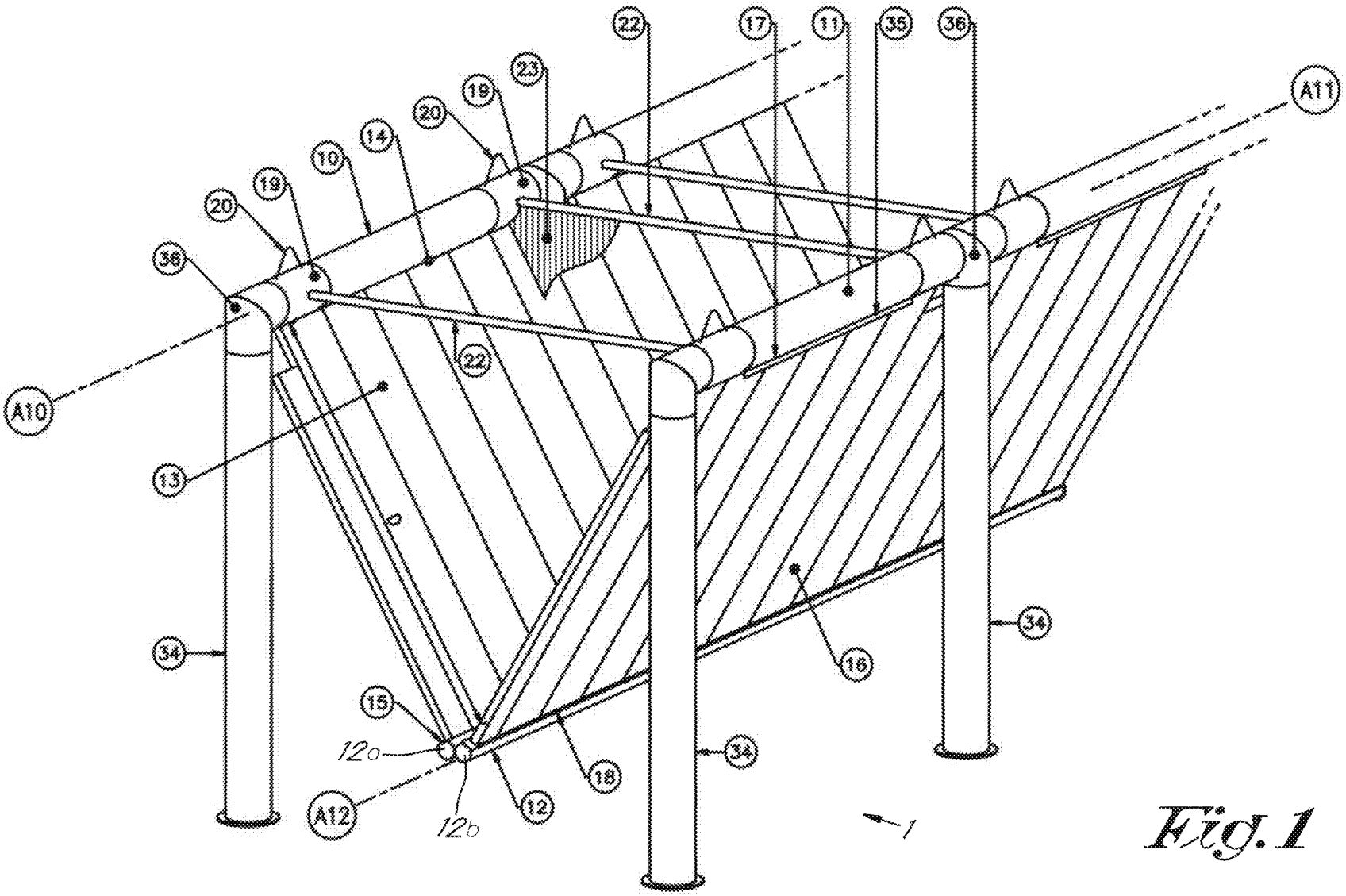
FIG. 1 is a schematic perspective view of a first embodiment of a unit according to the invention.

FIG. 1 shows a first type of embodiment for a cooling unit 1 according to the invention for cooling a condensable or partially condensable first fluid F1 by means of a second fluid F2 not in direct contact with each other. The unit is in particular a unit for partially condensing the first fluid F1 in the heat exchangers [13], [16] of the unit. The second fluid is, for example, air and/or a liquid (water) sprayed on the heat exchangers [13], [16], the second fluid advantageously crossing the heat exchangers.

Said unit forms an integral assembly capable of being displaced and mounted on a supporting structure and able to be connected or not to one or more other units to form a cooling assembly.

The embodiment of FIG. 1 is a form for which each unit 1 is independent of the others or can be used independently of one another. It is also possible to combine units with each other.

In this form of embodiment of the figure, the use of an intermediary building structure is not indispensable, although desired, since the vertical pipes [34] serve as supporting legs.

Figure 2:
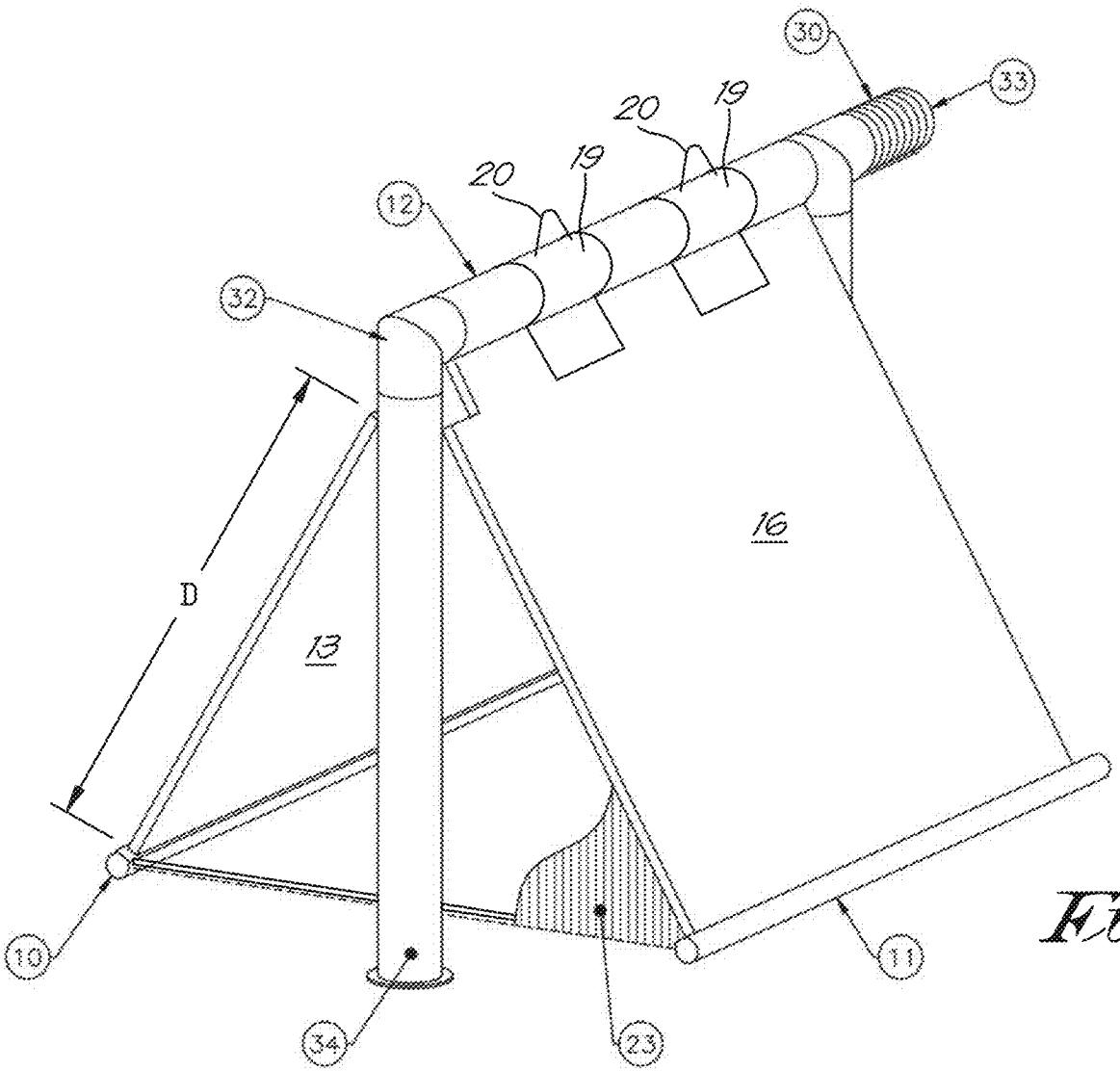
FIG. 2 is a schematic perspective view of a second embodiment of a unit according to the invention.

The embodiment in FIG. 2 is similar to that in FIG. 1, but units are not independent of each other, and are adapted to form a series of units connected to each other. The mounting of such a unit at ground level or near the ground advantageously requires an intermediate structure, advantageously mobile.

The cooling or partial condensation unit of the first fluid F1 (through calorie transfer from the Fluid F1 to a Fluid F2) comprises at least:

one first metallic pipe [10] with a first central axis [A10], one second metallic pipe [11] with a second central axis [A11] substantially parallel to said first central axis [A10], one third metallic pipe (simple [12] or multiple [12*a*] and [12*b*]), possibly with separate or distinct flow channels, said third metallic pipe [12] having a third central axis [A12] substantially parallel to said first central axis [A10] and to said second central axis [A11], said third pipe [12] being distant (Distance D measured perpendicular to the axis [A12]) of the first pipe and the second pipe of, ideally, 2 m or more than 2 m.

one first advantageously at least partially metallic heat exchanger [13] extending from a first longitudinal edge [14] adjacent to the first pipe [10] to a second longitudinal edge [15] adjacent to the third pipe [12], said heat exchanger [13] having an outer face adapted to be in contact with said second fluid (for instance air) and defining an inner chamber communicating with said pipe [10] and said third pipe [12] or a channel of the latter, allowing the first Fluid F1 to flow through said first metallic heat exchanger [13] between said first pipe [10] and said third pipe [12] or the channel of the latter or the other way around, (for example, it flows from top to bottom, thus from the pipe [10] to the pipe [12], in order to take advantage of the gravity). This heat exchanger has the shape of a series of tubes spaced from one another, for example of the flat tubes, the ends of which are welded to the pipes [10], [12], while ensuring a communication between the heat exchanger and said pipes.

one second advantageously at least partially metallic heat exchanger [16] (similar to the heat exchanger [13]) extends between a first longitudinal edge [17] adjacent to the second pipe [11] and a second longitudinal edge [18] adjacent to the third pipe [12], said second heat exchanger having an outer face adapted to be in contact with said second Fluid F2 and defining an inner chamber in communication with said second pipe [11] and said third pipe [12] or channel of the latter, allowing the first Fluid F1 to flow through said second metallic heat exchanger [16] between said second pipe [11] and said third pipe [12] or a channel of the latter or inversely.

The units according to FIGS. 1 and 2 are adapted to be pre-assembled and tested in the workshop or on the ground (in particular on site) before being installed in an installation. This allows a better quality control of the units before mounting them in the installation, to accelerate the overall assembly speed, and to avoid any repair work on units mounted on an often important height structure.

The unit 1 is adapted to ensure that the first and second heat exchangers [13], [16] are suspended along one of their upper longitudinal edges [14], [17] to a suspension pipe [12] (embodiment of FIG. 2) or to two suspension pipes [10], [11] (embodiment of FIG. 1). Heat exchangers [13], [16] are capable of undergoing, under the suspension pipe(s), a substantially free elongation and/or expansion curvature.

In the embodiment of FIG. 1, the first fluid to be partially condensed is brought in the form of vapor to the heat exchangers [13], [16] through pipes [10] and [11]. This first fluid is partially condensed in the heat exchangers [13], [16]. For example, between 70 and 95% of the volume of vapor introduced in the heat exchangers is condensed. The partially condensed Fluid F1 (in the form of liquid and vapor) flows out of the heat exchangers towards the multi-channel pipe [12], a channel collecting the Fluid F1 flowing out of the heat exchanger [13], while another channel collects the Fluid F1 flowing out of the heat exchanger [16]. In this form of embodiment, pipes [10] and [11] form suspension pipes.

In the embodiment of FIG. 2, the first fluid to be partially condensed enters in the form of vapor through pipe [12], in the heat exchangers [13], [16]. After partial condensation in the heat exchangers, the fluid F1 (in the form of liquid and vapor) flows out through pipes [10] and [11]. Here, pipe [12] is the suspension pipe.

The heat exchanger heat [13], [16] may have the form of a set of tubes placed in parallel, and bonded via a set comprising two plates welded at their ends to define a series of internal channels, said plates being perforated or pierced to form passages for the flow of the second fluid, etc. The set of heat exchanger tubes advantageously form a single piece, which can then be welded to a supply and suspension pipe.

Said suspension pipe [12] of the embodiment in FIG. 2 or said suspension pipes [10], [11] of the embodiment in FIG. 1 are attached to the first metallic heat exchanger [13] and/or to the second metallic exchanger heat [16] by reinforced means [19] able to bear completely, at least substantially, the tensile force generated by the weight of the heat exchanger considered on the suspension pipe of the heat exchanger in question. These reinforced means could be suitable welds between the suspension pipe and the first and/or second heat exchanger, and/or the use of one or more metallic tubes and/or thicker, brazed metallic fins, for example tube(s) adapted to be attached by welding to the suspension pipe, these tubes being advantageously thicker than 1.53 mm, in particular more than 1.55 mm, more than 1.6 mm, more than 2 mm, for example between 1.6 mm and 3 mm, in particular between 2 mm and 3 mm, and/or the use of one or more metallic tube(s), less thick or thicker than 1.53 mm, but associated with one or more brazed fin(s) with an installed thickness of more than 0.3 mm, for example with a thickness between 0.3 mm and 0.6 mm, such as 0.3 mm, 0.35 mm, 0.4 mm and 0.5 mm Advantageously, the reinforced means [19] are adapted to bear completely, at least substantially the tensile force generated by the weight of the heat exchanger considered filled with said partially condensed first fluid (in case of partial condensation of the first fluid, the weight of the heat exchanger filled with the first fluid in liquid form at 5 to 20% of the internal volume of the heat exchanger and in vapor form at 80 to 95% of the internal volume of the heat exchanger, the weight of the first fluid in the heat exchanger being for example determined or estimated at the temperature of 20° C. and at a given pressure, for example at atmospheric pressure) on the suspension pipe [10], [11] or [12] of the heat exchanger in question. This makes it possible to have a unit forming an assembly that can be moved, for example by lifting means. The assembly then has advantageously systems or loops [20] for the hooks of one or more lifting gears. These attachment systems are advantageously secured to one or several suspension pipes, for example via an intermediate element such as the reinforcing device. [19].

In particular, said one or more suspension pipes are attached to the first metallic heat exchanger and/or the second metallic heat exchanger by reinforced means [19] capable bearing at least 1.1 times, for example 1.2 times, or even 1.5 or more times, the maximum tensile stress generated by the weight of the heat exchanger considered filled with said partially condensed first fluid and/or cooled in the heat exchanger in partially vapor and partially liquid form (weight measured at 20° C.) on the suspension pipe of the heat exchanger considered. The reinforced means [19] are for example metal plates partially surrounding a suspension pipe and partially attached to a heat exchanger (or a flat element connecting the tubes thereof). The part surrounding the suspension pipe forms a kind of loop integral with the suspension pipe The unit may comprise at least two distinct means, for example in the form of bars [22] (extending for example between the reinforcements [19] of FIG. 1, one or more bars may be associated with a side wall or partition wall [23]

shown only partly in FIG. 1) to at least ensure a gap ranging from a minimum gap and a maximum gap between the first metallic pipe [10] and the second metallic pipe [11]. These distinct means [22] contribute to the reinforcement of the assembly as such, and to its rigidity, which is very useful when the unit is lifted.

In the embodiment of FIG. 2, one or more bar(s) [22] extend between pipes [10] and [11], these bars serve as a stabilizer when lifting the unit. These bars [22] can also serve as support means for a partition wall [23] (shown in part) extending below the heat exchangers [13], [16].

When units according to FIG. 2 are mounted in parallel, pipe [11] of a unit can be connected to pipe [10] of an adjacent unit.

In the embodiments of FIGS. 1 and 2, the suspension pipe(s) is (are) associated with a vertical segment serving as support legs. However, in case an intermediary mounting structure is used, units can be built without these segments, which makes the unit lighter and makes it easier to mount.

To make the best use of the space available on the ground, it is possible to use simplified units (with only one heat exchanger), for example at the ends of the installation.

Figure 5:
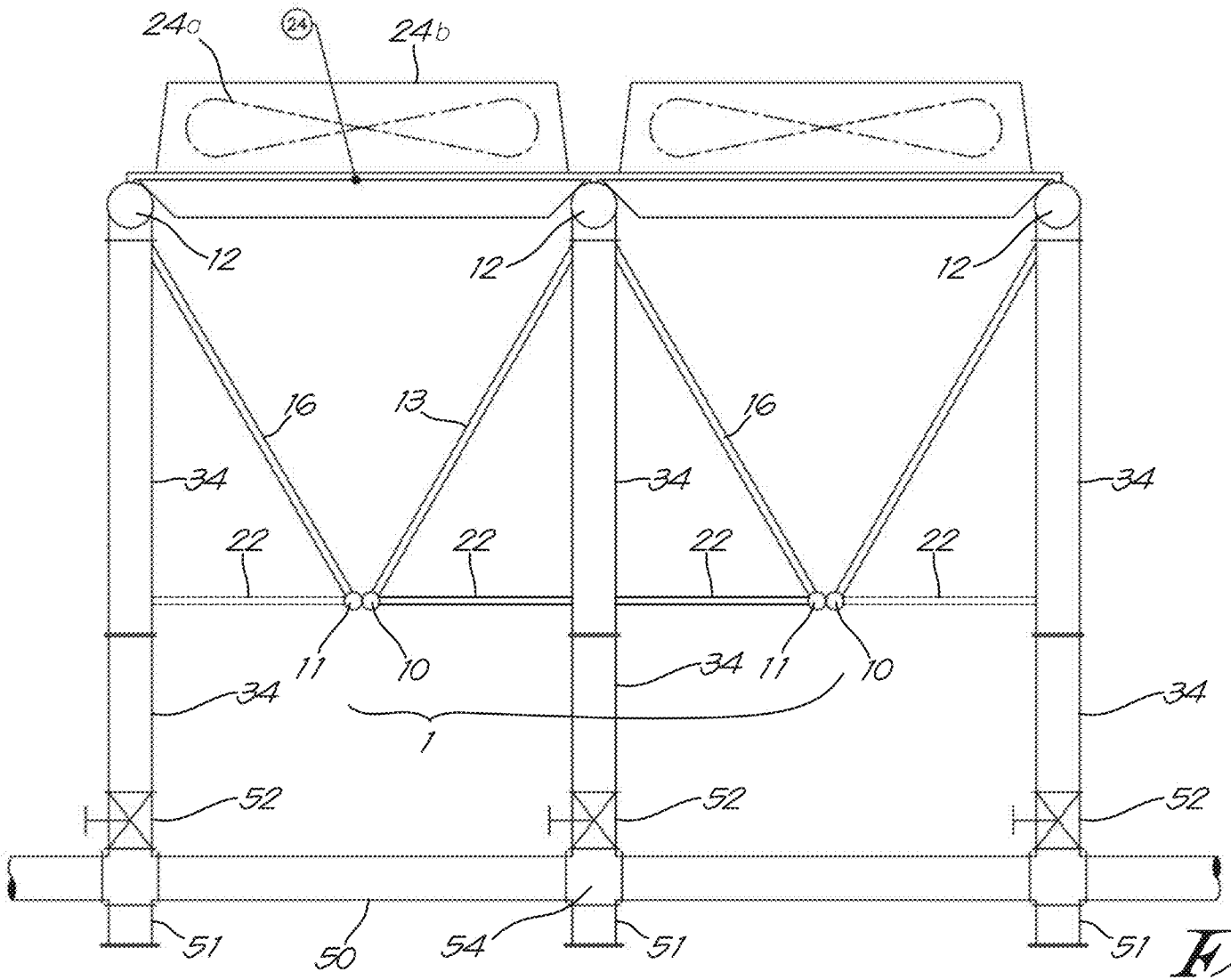
FIG. 5 is a perspective view of a platform with fan.

The suspension pipe(s) of the embodiments are advantageously adapted to bear at least 50% of the weight of a platform [24] (shown in perspective in FIG. 5) and of a fan [24*a*] (said fan being either mounted as removable from the platform, either fixed on the platform), said platform [24] bearing on two adjacent suspension pipes (either from the same unit—this is the case illustrated in FIG. 1, or from two adjacent units—this is the case illustrated in FIG. 2). The suspension pipe(s) is (are) advantageously adapted to resist crushing by the weight of one or platforms with fan(s). Advantageously, a fan is fixed on a platform using a fast fastening/release system, this allowing an easy placement or removal of the fan. Advantageously also, the connection between a platform and the suspension pipes is adapted to allow easy disassembly, as well as relative movements, for example in case of different dilation movements between the suspension pipe(s) and the platform(s). For example, the platform [24] could comprise arms [25] along the two opposed edges, these arms [25] being for instance the extremities of profiles. The location of the arms [25] along the first edge does not correspond with the location of the arms [25] along the opposed edge, in order to avoid an overlapping of the arms [25] of two platforms [24] partially bearing on the same segment of a suspension pipe.

Figure 6:
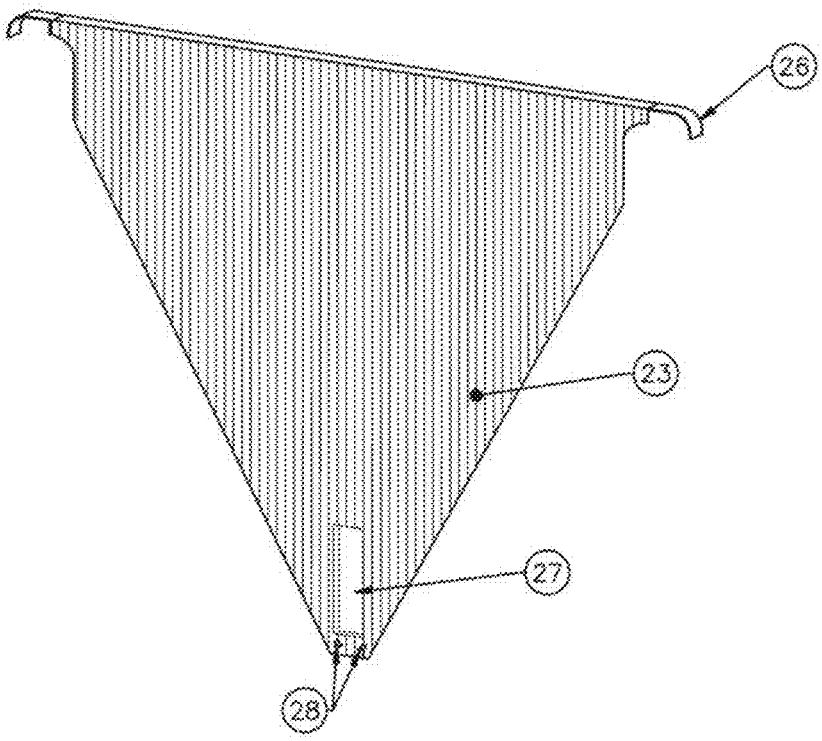
FIG. 6 is a perspective view of a lateral wall for a unit according to the invention.

Similarly, the lateral or partitioning or confinement wall(s) [23] (see FIG. 6) intended to form independent or substantially independent cells advantageously comprise a quick-fastening system [26] allowing easy assembly/disassembly on two suspension pipes of one unit or two adjacent units. The wall may advantageously have an opening with a door [27] adapted to give access to a bridge bearing on the pipe collecting the first fluid (vapor and liquid) flowing out of the heat exchanger [13] or [16].

Figure 4:
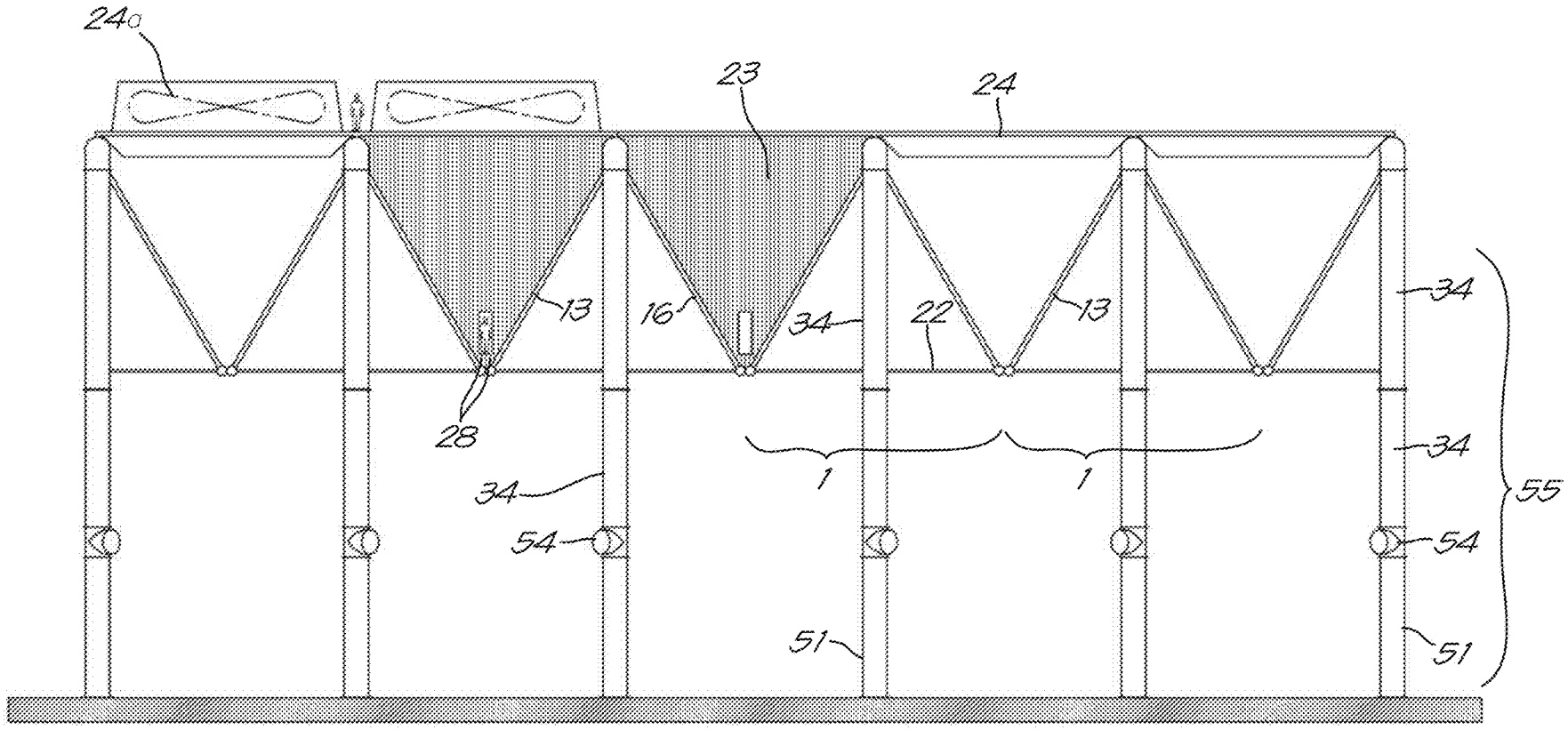
FIG. 4 is another view of part of an installation comprising a series of units according to FIG. 2, showing the main vapor feed pipe of the various vertical segments bringing vapor to the suspension pipes 12 of various units 1.
Figure 5:
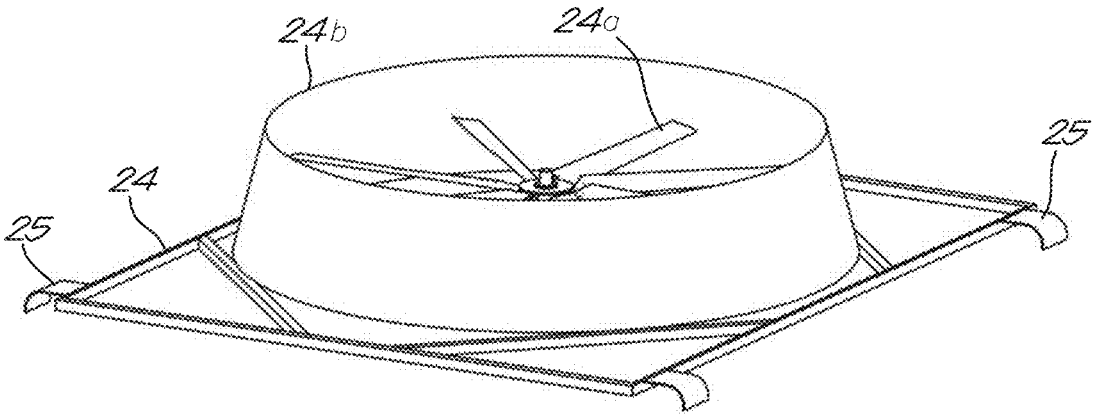

Partitioning or confinement walls [23] can be provided with attachment points [28] for the attachment of walkway extending between two adjacent or successive partitioning or confinement walls [23], as illustrated in FIG. 4. The walkways are advantageously mounted in a removable way between two walls [23].

In the embodiment illustrated in FIG. 1, the unit comprises two upper suspension pipes [10], [11], while the third lower pipe [12] comprises two adjacent pipes. Pipes [10] and [11] are intended for the distribution of vapor in the heat exchangers [13], [16], while the third pipe, formed by two adjacent pipes [12*a*] & [12*b*] is intended to collect the first fluid cooled and/or partially condensed in heat exchangers [13], [16].

In the embodiment illustrated in FIG. 2 comprising one single upper suspension pipe [12], the suspension pipe may present, at one of its ends at least, a mobile or extensible connection [30] with regard to the suspension pipe in question, adapted to compensate for the gap between the suspension pipe in question [12] and an adjacent suspension pipe from another unit. Such are valuable to ensure some space between the adjacent units, the suspension pipes of which must be connected together, this spacing being necessary for the easy placement or the easy removal of one unit in the vicinity of another, without damaging it.

The unit is advantageously adapted for cooling and/or partial condensing a first fluid in said first and second heat exchangers [13], [16].

Suspension pipes [10], [11] in the embodiment illustrated in FIG. 1 are supply pipes of the first fluid F1 to be cooled/condensed (for example vapor, like steam), while pipes [12*a*], [12*b*] are intended to collect the first fluid cooled/partially condensed (steam+ hot liquid water, for example), said pipes [12*a*], [12*b*] having a flow cross-section at the most 10 times smaller than the flow cross-section of supply pipes [10] or [11]. The second fluid F2 is for example air flowing through the heat exchangers [13], [16] in which the first fluid F1 is partially condensed.

According to a possible embodiment, the unit presents a gravity center extending substantially in a median plane between the first central axis [A10] and the second central axis [A11], and passing through said third central axis [A12], said gravity center being slightly offset relative to both lateral ends [32], [33] of the unit. This makes it possible to position one end of one or more suspension pipe(s) in front of the end(s) of the suspension pipes of another unit, before positioning the other end(s) relative to the structure, before connecting between them the adjacent end(s) of the suspension pipes of two adjacent units In the embodiments illustrated in FIGS. 1 and 2, the unit presents suspension pipe(s) prolonged at the bottom by a supply pipe section [34] each serving as a supporting leg when the unit is bearing on the ground. This or these segment(s) thus serve (s) as supporting leg(s) for the unit on the ground, these supporting legs can also participate in the suspension of the unit mounted on the main supply pipes. These legs may have a lower flange to facilitate their support at ground level. Each segment [34] is connected to an extremity of a suspension pipe by an intermediate connection element, elbow or a T [36].

One or more or all of said first, second and third metallic pipes [10], [11], [12] may or may not be associated with a longitudinal expansion compensator. Such an expansion compensator may be present at a connector for connecting one suspension pipe to another. The connector 30 can serve as a longitudinal compensator between two suspension pipes connected to one another.

The heat exchangers [13], [16] can be associated with an expansion compensator. Such compensators make it possible for example to limit strain at the points/zones of connection between two heat exchangers of the same unit, for example at the level of the pipe [12] in the embodiment type illustrated in FIG. 1.

One or more or the entire aforementioned first, second and third metallic pipes is/are/may be associated with a connection device to another pipe, said connecting device possibly comprising a valve. Such a coupling device may be a flange.

However, valves or gates are preferably mounted in the distribution network and not on the removable units As shown in FIG. 1, the unit is in the form of a substantially longitudinal assembly with two longitudinal faces inclined between them defined by the sides (advantageously perforated or pierced) of the heat exchangers [13], [16] (the openings are for instance defined between the different tubes), at least one outer lateral side of the unit being closed by a lateral or confinement wall [23] advantageously associated with an opening comprising a door. The third pipe [12] (formed by two distinct parallel pipes) extends advantageously to the junction between the sloped longitudinal faces ([13], [16]) and may possibly, but advantageously, be associated with a walkway. Sidewalls of adjacent units define separate cells for separate induced or forced airflows.

The suspension pipe(s) may have one or more longitudinal reinforcements [35], which may have one or more passages that can serve as anchoring or attachment points for lifting devices, for example to lifting bars.

When positioned for use in the supporting structure of the installation, the distribution (suspension) or collection pipe(s) is (are) advantageously substantially horizontal, even slightly inclined.

Suspension pipes are intended for the distribution of the first fluid F1 (in vapor form) in heat exchangers [13], [16], the extremities of each suspension pipe being adapted to be connected via an intermediary element [36] to a substantially vertical supply pipe [34], used to feed each suspension pipe and thus the unit through one or both of its extremities, or by one specific extremity when using one or more gate(s) [53].

The platform [24] may comprise a set of beams and profiles connected between them to form a support for the fan [24*a*] and its peripheral guide [24*b*]. The platform [24] is perforated or has pierced grids allowing persons to circulate during maintenance works. The fan [24*a*] and its peripheral guide are advantageously mounted on the platform in such a way that it can be removed.

FIGS. 3 and 4 show a series of units according to FIG. 2 positioned next to each other.

In FIG. 3, each unit is fed from a lower general vapor supply network [50] close to the ground and located under the heat exchangers [13], [16] of units 1. Moreover, the network comprises a series of substantially vertical supply pipes [51], which may be associated, totally or partially, to an isolation valve [52]. The supply pipes [51] serve as support pillars for the segments [34] of units 1. In this way, units 1 are connected to the distribution network [50]. Once connected to the supply network, units are associated with sidewalls [23] (the legs of the latter resting on two adjacent suspension pipes [10], [11]). The platform is then placed with the fan (to generate an air flow) on top of each unit, the arms of the platform thus resting on the suspension pipes.

FIG. 4 shows that the support structure [55] comprises a series of vertical supporting pipe [51] (possibly with one or more isolation valves [52]) destined to be connected to a vapor feed network [50] via a connecting element [54]. The upper section of each vertical supporting pipe [34] is associated through an intermediate connecting element [32], [36] to the suspension pipe [12], which is also a distribution pipe for vapor in the heat exchangers [13], [16].

Lateral or confinement walls [23] are placed between two sloping faces of two adjacent units, while platforms [24] with fan are positioned so they can bear on two suspension pipes of two adjacent units.

The collecting pipes [10], [11] of two adjacent units are connected between them, which ensures a better stability to the structure.

Figure 7:
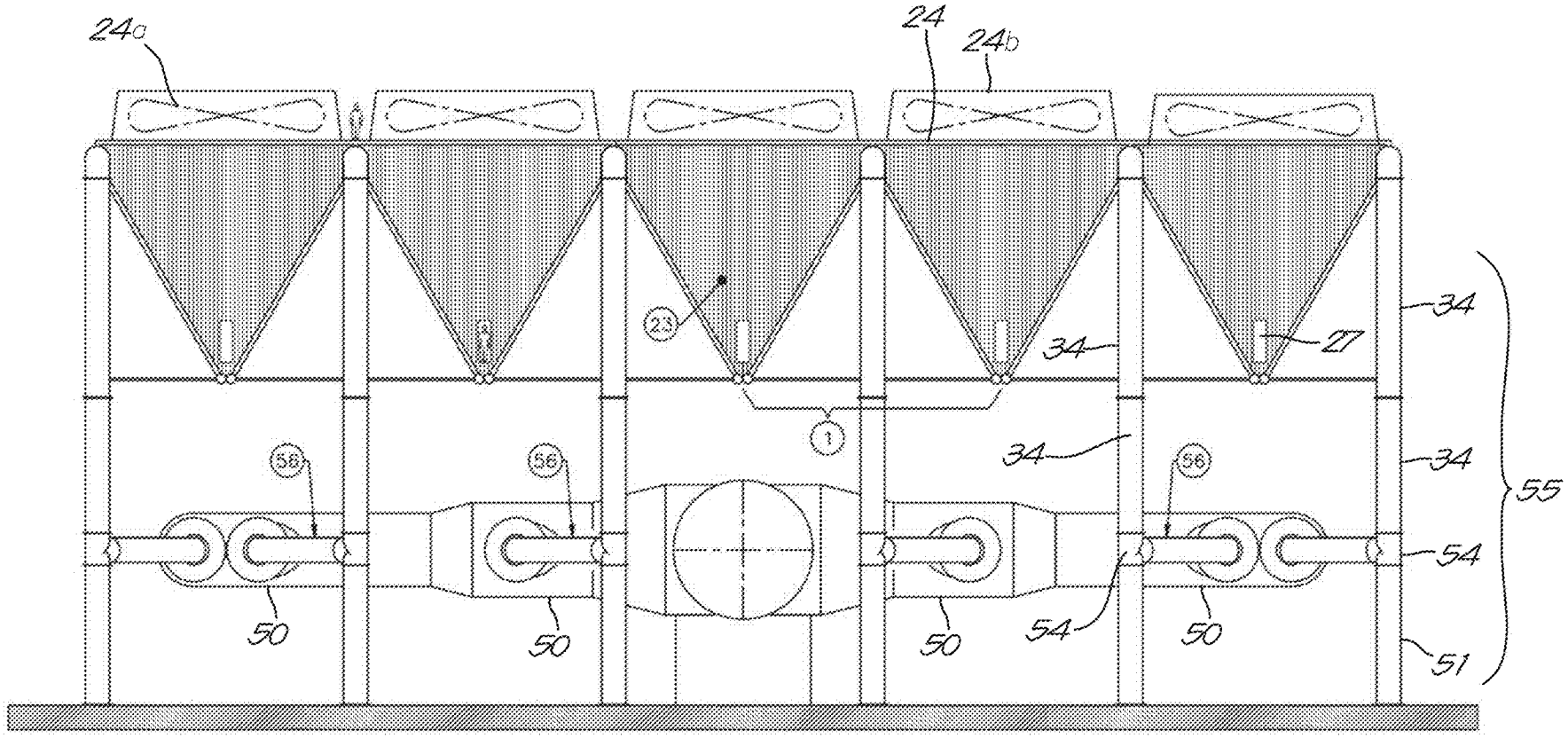
FIG. 7 is a front view of an installation according to the invention.

FIG. 7 shows the embodiment of FIG. 4 with the lateral or containment walls to define a series of distinct cells, as well as the lower distribution network [50] connected to the different vertical pipes [51] for bringing the vapor to different units 1. As seen in this figure, the supply ducts of the network [55] are of large section, but this section is reduced towards the ends remote from the central intake. The distribution network is then connected to the different vertical support pipes [51] via an intermediate element [56] able to compensate for relative expansion displacements and advantageously associated with a valve.

Figure 8:
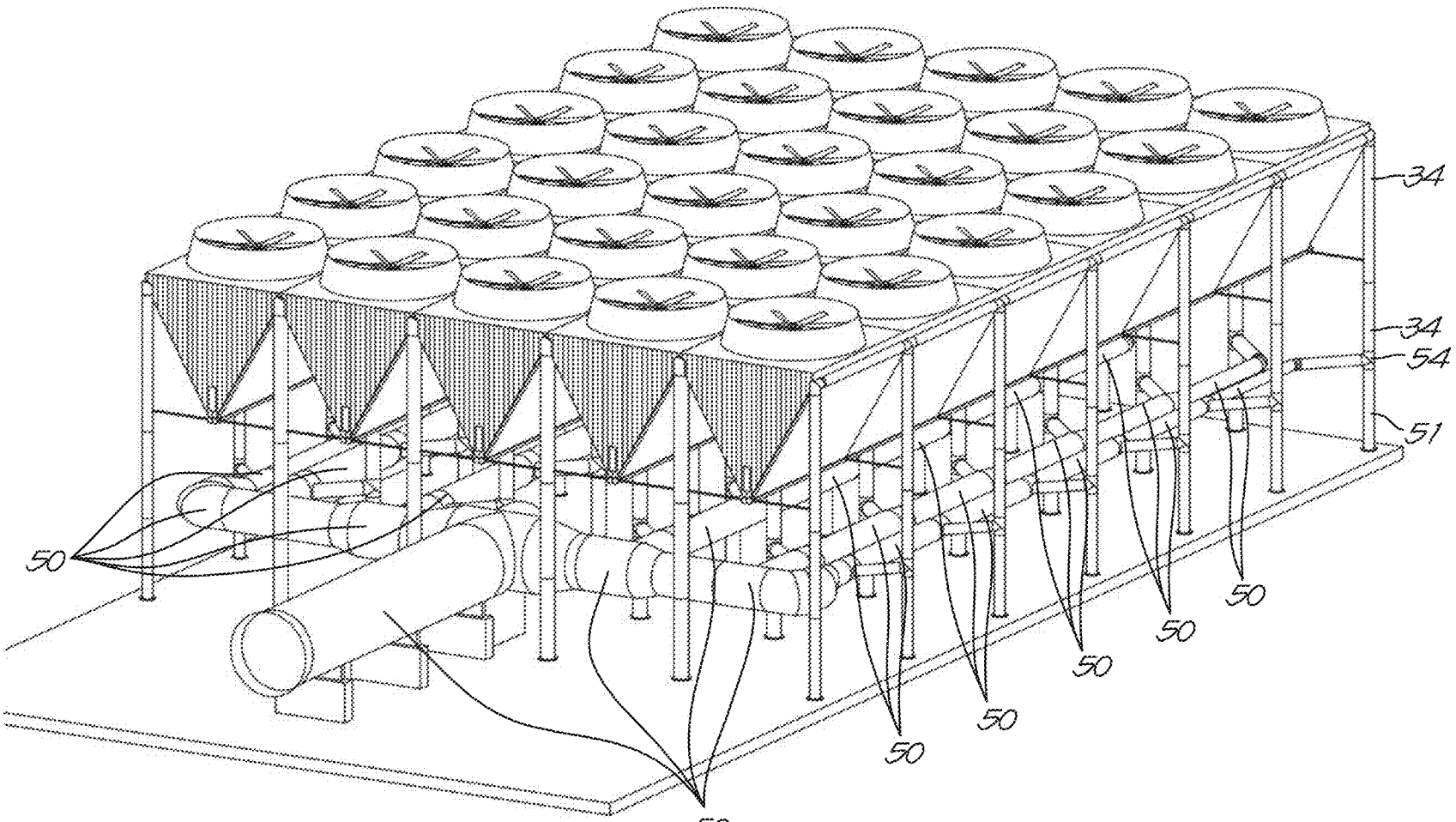
FIG. 8 is a perspective view of the installation of FIG. 7.

FIG. 8 is a view of FIG. 7, partially in perspective.

The installation shown in the figures, by way of example only, is an installation for cooling or partial condensation of a first fluid (for example a first fluid that is at least partially condensed, for example steam). A second fluid (for example water sprayed on one side of the heat exchanger, or air, or an air-water mixture) is provided, said installation comprising at least one supporting structure intended to carry or to allow the suspension at least one series of cooling units or (partial) condensation units according to the invention and connected to each other at least for supplying the first fluid to different first and second heat exchangers, or the suspension pipes bearing on the support structure, while heat exchangers are suspended to the suspension pipe(s). This limits the size and bulk of structures built with beams and other metallic profiles. The support structure [55] may, in a valuable embodiment, be built with vertical supply pipes [51] and [34].

The installation according to the invention results, for the same efficiency of cooling and vapor condensation by air, in less steel consumption (the fact of having a lighter installation also requires smaller pillars or foundations), a better use of space since it is possible to have the distribution network below the heat exchangers, greater layout flexibility, limited load loss, better access, etc.

In the embodiment illustrated, the supporting structure of the units is substantially only or mainly made of substantially vertical vapor supply pipes associated with, in their upper section, a connecting element and at least one suspension pipe according to the invention, said substantially vertical pipe used advantageously as supporting structure for at least one part of the unit in question.

The installation comprises a series of units according to the invention, of which the suspension pipe(s) are each associated with at least two substantially vertical pipes with interposition of a connecting element, said at least substantially vertical pipes used as supporting structure for at least one part of the unit in question, advantageously of the unit in question. According to a possible embodiment, each suspension pipe of a unit is suspended on three elements, namely two substantially vertical pipes to bring the first fluid to be cooled and an intermediate pillar supporting a central zone of the suspension pipe in question.

The installation is advantageously used for the condensation, at least partial, of a first partially condensed fluid using a second fluid in contact with the heat exchangers. It comprises a network of supply pipes of the first fluid to be partially condensed located under the lower level of the heat exchangers of the different units, a series of substantially vertical pipes connected with suspension pipes of said units, and advantageously a network to collect the first, partially condensed fluid (the first fluid flowing out of the heat exchangers in the form of a vapor-liquid mix, the pressurized vapor pushing the liquid into the ducts [12*a*], [12*b*] of the pipe [12]) from the heat exchangers [13], [16].

Said substantially vertical supporting pipes can present one or more vertical and/or horizontal reinforcements, advantageously at least substantially vertical/vertical, preferably located at least outside the substantially vertical pipes. Such vertical pipes serve advantageously, at least partially as structure to bear one extremity of a suspension pipe.

Said at least two substantially vertical supply pipes bearing a suspension pipe can present one or more vertical and/or horizontal reinforcement(s), advantageously at least substantially vertical, preferably located at least outside the supply pipes. When the vertical pipe is extended via an elbow to a substantially horizontal vapor distribution pipe of a unit, one or more reinforcement(s) extends advantageously at least close to the elbow between the vertical pipe and the horizontal pipe. When the substantially vertical supply pipe comprises one or more substantially vertical reinforcement(s) and when the substantially horizontal distribution pipe presents one or more horizontal reinforcement(s), one or more sloping reinforcement(s) extends advantageously between one or more vertical reinforcement(s) vertical and one or more horizontal reinforcement(s).

According to the embodiment, the substantially vertical supply pipe presents a section that extends at a level above the substantially horizontal distribution and suspension pipe of the unit, and one or more sloping reinforcement(s) or a plane advantageously extending between one or more vertical reinforcement(s) of the vertical pipe and one or more horizontal reinforcement(s) of the distribution pipe. To ensure better strain distribution, rings or collars can link the reinforcements between them, for example close to their free extremities.

The vertical pillars can be associated at their base with an expansion compensator, for instance to ensure that the suspension pipes of a unit remain substantially horizontal.

The installation comprises a distribution network for the first fluid extending at ground level or close to the ground and connected to a series of supply and supporting pipes for the units according to the invention.

The distribution network advantageously comprises valves and/or diverting pipes to isolate one or more unit(s) according to the invention of a distribution network. The distribution network comprises one or more means to absorb, at least partially, dilatation movements.

The installation advantageously comprises a collecting network for the first fluid after its passage and its condensation in the heat exchangers.

This network comprises a series of downpipes each associated with one or more drains for the first fluid outside the heat exchangers. Downpipes are advantageously associated with said drains via an intermediate element able to compensate distortion, particularly an expansion joint. This network is then advantageously connected with a collecting basin or tank. Advantageously, downpipes are not used as devices to support the suspended heat exchangers.

The installation is advantageously in an at least partially removable form, with removable elements and able to be replaced by new or repaired elements.

Removable elements, for example to allow an exchange of a defective element by another or to allow the repair of a defective element at ground level, are for example, the units according to the invention, the lateral or containment walls, and the platforms with or without fan(s), and the fans.

The installation according to the invention can thus be in the form of a series of modules pre-assembled and welded to the ground (or near the ground, for example on an intermediate supporting structure), on the site of the building site, or in a factory. The modules can thus be pre-tested (for example to check their tightness) before mounting. The installation can thus have the form of a series of modules ready to be mounted and to be connected together. Such an installation can then be more an installation for emergency work or emergency repair work, for example before reconstruction or repair of the original installation.

The supply pipes are associated at their base with a device allowing their connection to a source of vapor in different directions. This then makes it possible to connect separate modules or units in different directions, and then makes it possible to best adapt to the free space or the layout of the free space for the placement of modules or units. The pipes are advantageously equipped with valves to control the flow of vapor to the different units. The supply pipes advantageously define a basic circuit in one loop or with several loops so as to be able to feed the same unit by at least two distinct paths.

The installation comprises one or more means for associating it with one or more other units according to the invention or even with heat exchanger units not according to the invention.

Said two substantially vertical supply pipes may be associated along their internal/external surface with one or more substantially vertical fin(s) serving as internal and/or external reinforcement. Such internal and/or external reinforcements may for example be I beams welded on the internal and/or external wall of the pipe, possibly one or more cross-beam(s) extending between beams diametrically opposed to the central axis of the pipe.

The installation according to the invention makes it possible to reduce the necessary size of the structures with beams and profiles, and reduces the bulk. This also makes it possible to support platforms with fan(s) on a structure less subject to the strain generated in heat exchangers and pipes. In one possible embodiment, the installation comprises two independent structures, one bearing the platforms with fan (s), and a second bearing the heat exchangers.

The distribution network may comprise one or more expansion joints allowing to compensate for the dilation effects, fixed supports, movable supports, and any combinations of such devices.

Figure 9:
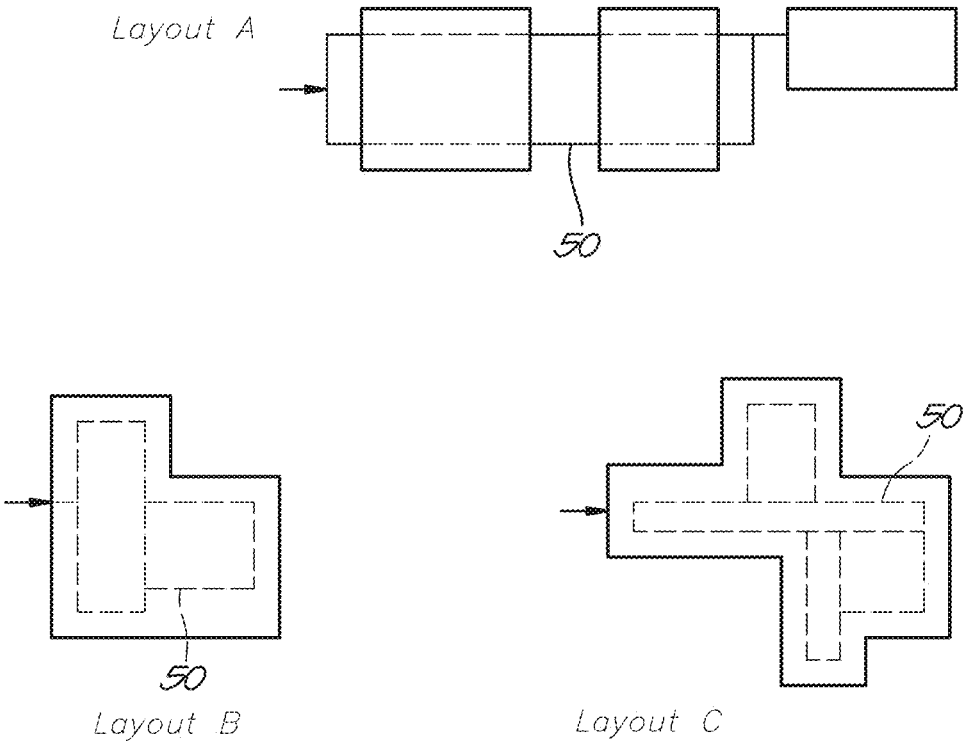
FIG. 9 is a view of the various placements possible for units according to the invention placed next to each other, or possible arrangements of units forming distinct groups interconnected by one or more supply pipes located near the ground.

FIG. 9 shows thee possible forms of embodiment of the installations according to the invention.

In layout A, the installation comprises three parts I1, I2 and I3 separated from each other, but built with units according to the invention, the three parts being connected to the same distribution circuit [50], comprising a segment defining a loop.

In layout B, the installation has a non-rectangular outline, this to match the available space as well as possible. The vapor distribution circuit [50] of the installation comprises two loops interconnected and possibly comprising valves.

In layout C, the installation follows an even more complex outline than in layout B. The distribution circuit comprises four distribution loops connected between them to feed the different units.

The invention further relates to the use of an installation following the invention for cooling, in particular condensing a first fluid by means of a second fluid, particularly air.

The method according to the invention is therefore a cooling method for first fluid by means of a second fluid, in an installation according to the invention, in which the first fluid is fed into heat exchangers of units according to the invention and wherein said heat exchangers are in contact with a second fluid.

The first fluid flows inside the heat exchangers, while the second fluid flows outside the heat exchangers.

In this process, an installation comprising platforms is advantageously used in in association with one or more motor-fan group(s) bearing on two suspension pipes. In this process, when a significant problem is detected or a major maintenance must be performed in one or more motor-fan group(s) of a platform or in a unit according to the invention, the defective motor-fan group(s) and/or the platform with the motor-fan group(s) with significant problem is lifted to be replaced by one or more new motor-fan group(s) or one or more moto-fan group(s) in working order and/or at platform or to move at ground level for its repair, before its replacement on the platform and/or before positioning the platform to make it bear on the two suspension pipes of one or more units according to the invention, and/or after having lifted one or more motor-fan group(s) and/or one or more platforms with motor-fan group(s) bearing on one or more of the suspension pipes, the unit with the problem or requiring major maintenance is lifted, for replacing it by another unit and/or to move it at ground level or at the level of a temporary and/or mobile supporting structure for its maintenance or its repair before its replacement, and the platform(s) with or without motor-fan group(s) is (are) repositioned so it (they) can bear on at least one of the suspension pipes of the replaced or maintained unit, and a motor-fan group is put again on the repositioned platform(s), if the motor-fan group had been removed for this or these platforms.

In this process, the replacement can be done rapidly after having interrupted the operation of the installation. Preferably, however, the installation comprises means adapted to isolate one or more units according to the invention, so as to be able to perform the replacement without having to stop the operation of any installation according to the invention. To isolate one or more units, it is possible to close one or more valves of a network distribution, and/or to transfer part of the first fluid to other units by means of branch pipes.

The subject of the invention is also a method for constructing an installation according to the invention, comprising at least the following steps:

establishing a supporting structure on a selected site;

building units of the invention at ground level, close to the site, or transport of units according to the invention close to the site;

lifting of the units for their placement on the supporting structure, so that units can bear on the supporting structure, in order to be suspended via their suspension pipe(s).

Platforms with fans can also be assembled at ground level or in the workshop before being mounted in one piece in the installation according to the invention. Fans can also be mounted after placing platforms.

Figure 10:
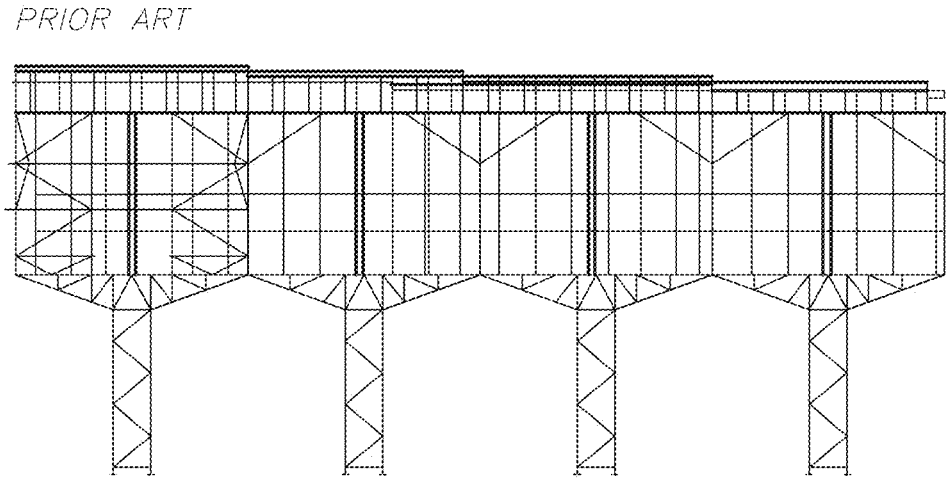
FIG. 10 is a schematic view of a structure known for bearing heat exchangers and distribution pipes (figure from DE20 2014 104 666).

By way of comparison, FIG. 10 schematically shows a structure of the known type. This structure consisting of profiles is complex, cumbersome, and must bear all the strain generated by distribution pipes, heat exchangers and fans. Such structures require significant time for their embodiment.

NOMENCLATURE OF THE FIGURES

[1] unit according to the invention
F1 first fluid to be cooled and/or at least partially condensable, for instance superheated steam
F2 second fluid, for instance air
[10] first metallic pipe
[A10] central axis of the first pipe
[11] second metallic pipe
[A11] central axis of the second pipe
[12] third metallic pipe ([12*a*], [12*b*]: conduits or channels of the third pipe [12])
[A12] central axis of the third pipe
[13] first heat exchanger
[14], [15] longitudinal edges du first heat exchanger
[16] second heat exchanger
[17], [18] longitudinal edges du second heat exchanger
D Distance between two pipes
[19] reinforcement device
[20] hanging loops, possibly removable
[22] bars
[23] lateral or confinement wall
[24] platform
[24*a*] fan
[24*b*] fan guide to guide the at least outgoing air flow
[25] platform arms
[26] confinement wall legs
[27] door or opening of the confinement wall
[28] attachment points for walkway
[30] mobile/extensible connection
[32], [33] lateral ends of the unit
[34] segment of substantially vertical supply pipe
[35] suspension pipe reinforcement,
[36] connection element or elbow, intermediate element
[50] supply network
[51] vertical supporting pipe
[52] valve
[54] intermediate linking or connection element
[55] structure =[51]+[54]+[34]
[56] intermediate element or diverting element
I1, I2, I3 parts of the installation comprising units according to the invention

The invention claimed is:

1. An installation for the cooling and at least partial condensing a first at least partly condensable fluid by a second fluid not in direct contact with the first at least partly condensable fluid, said installation comprising a supporting structure designed to carry at least one series of cooling units for the cooling and the at least partial condensing, as well at least partial condensation of the said first at least partly condensable fluid, whereby said at least one series of cooling units are connected between them and to a feeding system for the feeding of the first at least partly condensable fluid to said at least one series of cooling units, whereby the units of said at least one series of cooling units are each a cooling unit forming an integral assembly adapted to be moved and mounted on the supporting structure, said cooling unit comprising at least:

one first metallic pipe with a first central axis, one second metallic pipe with a second central axis substantially parallel to said first central axis one third metallic pipe element selected from the group consisting of a simple metallic pipe and a multiple metallic pipe element, said third metallic pipe element having a third central axis substantially parallel to said first central axis and to said second central axis, said third metallic pipe element being distant from the first pipe and the second pipe by a distance of at least 2 meters, one first at least partially metallic heat exchanger having a first longitudinal edge and a second longitudinal edge opposite to said first longitudinal edge and being distant from said first longitudinal edge of said first at least partially metallic heat exchanger, said first longitudinal edge of said first at least partially metallic heat exchanger extending adjacent to the first pipe, while the said second longitudinal edge of said first at least partially metallic heat exchanger extends adjacent to the third metallic pipe element, said first at least partially metallic heat exchanger having an external side adapted to be in contact with said second fluid [F2] and defining an inner chamber communicating with said first metallic pipe and said third metallic pipe element, allowing the first fluid [F1] to flow through said inner chamber of said first at least partially metallic heat exchanger for directing the first fluid according to a flow selected from the group consisting of a first flow for directing the first fluid from said first metallic pipe towards said third metallic pipe element through at least a first portion of the said inner chamber of said first at least partially metallic heat exchanger, a second flow for directing the first fluid from said third metallic pipe element towards said first metallic pipe through at least a second portion of the said inner chamber of said first at least partially metallic heat exchanger, and combinations thereof, one second at least partially metallic heat exchanger having a first longitudinal edge and a second longitudinal edge opposite to the said first longitudinal edge of the second at least partially metallic heat exchanger, said first longitudinal edge of the second at least partially metallic heat exchanger extending adjacent to the second metallic pipe, while the said second longitudinal edge of the second at least partially metallic heat exchanger extends adjacent to the third metallic pipe element, said second at least partially metallic heat exchanger having an external side adapted to be in contact with said second fluid [F2] and defining an inner chamber communicating with the said second metallic pipe and the said third metallic pipe element, allowing the first fluid [F1] to flow through said inner chamber of said second at least partially metallic heat exchanger according to a flow selected from the group consisting of a first flow for directing the first fluid [F1] from said second metallic pipe towards said third metallic pipe element through at least a first portion of the said inner chamber of said second at least partially metallic heat exchanger, a second flow for directing the first fluid [F1] from said third metallic pipe element towards said second metallic pipe through at least a second portion of the said inner chamber of said second at least partially metallic heat exchanger, and combinations thereof, whereby each of said cooling unit forming an integral assembly adapted to be moved and mounted on the supporting structure is adapted to ensure:

(i) that the first at least partially metallic heat exchanger is suspended to one metallic suspension pipe bearing on the supporting structure, said one metallic suspension pipe of the first at least partially metallic heat exchanger being selected from the group consisting of the first metallic pipe and the third metallic pipe element respectively along the first longitudinal edge and along the second longitudinal edge of the said first at least partially metallic heat exchanger, whereby the said first at least partially metallic heat exchanger is suspended at a level below the said one metallic suspension pipe of the first at least partially metallic heat exchanger and is capable of being submitted to an expansion below the said one metallic suspension pipe of the first at least partially metallic heat exchanger selected among the group consisting of substantially free elongation, substantially free expansion curvature and combinations thereof, and (ii) that the second at least partially metallic heat exchanger is suspended to one metallic suspension pipe bearing on the supporting structure, said one metallic suspension pipe of the second at least partially metallic heat exchanger being selected from the group consisting of the second metallic pipe and the third metallic pipe element respectively along the first longitudinal edge and along the second longitudinal edge of the said second at least partially metallic heat exchanger, whereby the said second at least partially metallic heat exchanger is suspended at a level below the said one metallic suspension pipe of the second at least partially metallic heat exchanger and is capable of being submitted to an expansion below the said one metallic suspension pipe of the second at least partially metallic heat exchanger, said expansion being selected among the group consisting of substantially free elongation, substantially free expansion curvature and combinations thereof;

whereby the first at least partially metallic heat exchanger has a weight generating a traction force on the said one metallic suspension pipe selected from the group consisting of the first metallic pipe and the third metallic pipe element, the said first at least partially metallic heat exchanger being attached to the said one metallic suspension pipe selected from the group consisting of the first metallic pipe and the third metallic pipe element by at least an element able to bear at least substantially totally the traction force generated by the weight of the first at least partially metallic heat exchanger, and whereby the second at least partially metallic heat exchanger has a weight generating a traction force on the said one metallic suspension pipe selected from the group consisting of the second metallic pipe and the third metallic pipe element, the said second at least partially metallic heat exchanger being attached to the said one metallic suspension pipe selected from the group consisting of the second metallic pipe and the third metallic pipe element by at least an element means able to bear at least substantially totally the traction force generated by the weight of the second at least partially metallic heat exchanger, in which several units of the said at least one series of cooling units have each one metallic suspension pipe which is provided at its two opposite ends respectively with a first connection element and a second connection element, whereby the supporting structure is comprising a series of substantially vertical supporting pipes, and whereby, for each of said several units, the first connection element is associated to one substantially vertical supporting pipe of said series of substantially vertical supporting pipes, while the second connection element is associated to another substantially vertical supporting pipe of said series of substantially vertical supporting pipe.

2. The installation of claim 1, in which the supporting structure comprises at least a series of substantially vertical pipes associated, in their upper section, with an element connecting with at least one metallic suspension pipe of several cooling units of the said at least one series of cooling units.

3. The installation of claim 2, in which the at least a series of said substantially vertical pipe are serving as part of the supporting structure for supporting units of the said at least one series of cooling units.

4. The installation of claim 1, in which the cooling units of the said series of cooling units have each the heat exchangers located at a level above a predetermined level for each considered cooling unit of the said series of cooling units, in which the installation further comprise (i) a supply network with supply pipes for the first fluid to the be condensed, said supply network being located for each cooling unit of said cooling units of the said series under the said predetermined level for the cooling unit in consideration, (ii) a series of substantially vertical supply pipes connected to metallic suspension pipes of the cooling units of said series, and (iii) a collecting network to collect the at least partially condensed first fluid flowing out of the heat exchangers of the cooling units of the said series.

5. The installation of claim 4, in which the said substantially vertical supply pipes have each an outer face, and in which at least some of the said substantially vertical supply pipes are provided along their outer face with at least one reinforcing elements selected from the group consisting of substantially vertical reinforcements, substantially horizontal reinforcements, and combinations thereof.

6. The installation of claim 4, in which the said substantially vertical supply pipes have each an inner face, and in which at least some of the said substantially vertical supply pipes are provided along their outer face with at least one reinforcing elements selected from the group consisting of substantially vertical reinforcements, substantially horizontal reinforcements, and combinations thereof.

7. The installation of claim 1, which is at least partly dismountable form, whereby at least one element selected from the group consisting of the cooling units of the said series, platforms with fan bearing on metallic suspension pipes of cooling units of the said series, fans bearing on platforms bearing on metallic suspension pipes of cooling units of the said series can be removed from the installation.

8. The installation of claim 1, in which for the cooling units of the said series of cooling units, the first at least partially metallic heat exchanger having its inner chamber filled with 5% to 30% in volume by the liquid medium issued from the condensation of said at least partly condensable vapour and with 70% to 95% in volume by the at least partly condensable vapour has a weight generating a traction force on the said one metallic suspension pipe selected from the group consisting of the first metallic pipe and the third metallic pipe element, the said first at least partially metallic heat exchanger being attached to the said one metallic suspension pipe selected from the group consisting of the first metallic pipe and the third metallic pipe element by at least an element able to bear at least substantially totally at least 1.1 times the traction force generated by the weight of the first at least partially metallic heat exchanger having its inner chamber filled with 5% to 30% in volume by the liquid medium issued from the condensation of said at least partly condensable vapour and with 70% to 95% in volume by the at least partly condensable vapour, and whereby the second at least partially metallic heat exchanger having its inner chamber filled with 5% to at most 30% in volume by the liquid medium issued from the condensation of said at least partly condensable vapour and with 70% to 95% in volume by the at least partly condensable vapour has a weight generating a traction force on the said one metallic suspension pipe selected from the group consisting of the second metallic pipe and the third metallic pipe element, the said second at least partially metallic heat exchanger being attached to the said one metallic suspension pipe selected from the group consisting of the second metallic pipe and the third metallic pipe element by at least an element able to bear at least substantially totally at least 1.1 times the traction force generated by the weight of the second at least partially metallic heat exchanger having its inner chamber filled with at 5% to 30% in volume by the liquid medium issued from the condensation of said at least partly condensable vapour and with 70% to 95% in volume by the at least partly condensable vapour.

9. The installation of claim 1, in which for the cooling units of the said series of cooling units, the cooling unit further comprises at least two distinct control spacing elements extending between the first metallic pipe and the second metallic pipe for ensuring the first metallic pipe to be distant from the second metallic pipe by a distance comprised between a minimum distance and a maximum distance.

10. The installation of claim 1, in which at least one metallic suspension pipe of a first cooling unit of the said series of cooling units is connected to at least one metallic suspension pipe of a second cooling unit of the said series of cooling units different from the first, by a connection system selected from the group consisting of a mobile connection system which has at least a portion mobile with respect to the metallic suspension pipe considered, an extensible connection system which has at least a portion extensible with respect to the metallic suspension pipe considered, and combination thereof.

11. The installation of claim 1, in which for the cooling units of the said series of cooling units, a median plane is defined between the first central axis and the second central axis, and goes through said third central axis, in which the unit extends between a first lateral end and a second lateral end opposite to said first lateral end, whereby the cooling units of the said series of cooling units have each a centre of gravity extending substantially in the said median plane, said centre of gravity located between the said first lateral end and the said second lateral end being offset relative to the said first lateral end and the said second lateral end.

12. The installation of claim 1, in which, for at least some cooling units of the said series of cooling units, at least one pipe selected from the group consisting of the first metallic pipe, the second metallic pipe and the third metallic pipe element is associated with a valve for connecting said pipe to another pipe.

13. An installation for the cooling and at least partial condensing a first at least partly condensable fluid by a second fluid not in direct contact with the first at least partly condensable fluid, said installation comprising a supporting structure designed to carry at least one series of cooling units for the cooling and the at least partial condensing, as well at least partial condensation of the said first at least partly condensable fluid, whereby said at least one series of cooling units are connected between them and to a feeding system for the feeding of the first at least partly condensable fluid to said at least one series of cooling units, whereby the units of said at least one series of cooling units are each a cooling unit forming an integral assembly adapted to be moved and mounted on the supporting structure, said cooling unit comprising at least:

one first metallic pipe with a first central axis, one second metallic pipe with a second central axis substantially parallel to said first central axis one third metallic pipe element selected from the group consisting of a simple metallic pipe and a multiple metallic pipe element, said third metallic pipe element having a third central axis substantially parallel to said first central axis and to said second central axis, said third metallic pipe element being distant from the first pipe and the second pipe by a distance of at least 2 meters, one first at least partially metallic heat exchanger having a first longitudinal edge and a second longitudinal edge opposite to said first longitudinal edge and being distant from said first longitudinal edge of said first at least partially metallic heat exchanger, said first longitudinal edge of said first at least partially metallic heat exchanger extending adjacent to the first pipe, while the said second longitudinal edge of said first at least partially metallic heat exchanger extends adjacent to the third metallic pipe element, said first at least partially metallic heat exchanger having an external side adapted to be in contact with said second fluid [F2] and defining an inner chamber communicating with said first metallic pipe and said third metallic pipe element, allowing the first fluid [F1] to flow through said inner chamber of said first at least partially metallic heat exchanger for directing the first fluid according to a flow selected from the group consisting of a first flow for directing the first fluid from said first metallic pipe towards said third metallic pipe element through at least a first portion of the said inner chamber of said first at least partially metallic heat exchanger, a second flow for directing the first fluid from said third metallic pipe element towards said first metallic pipe through at least a second portion of the said inner chamber of said first at least partially metallic heat exchanger, and combinations thereof, one second at least partially metallic heat exchanger having a first longitudinal edge and a second longitudinal edge opposite to the said first longitudinal edge of the second at least partially metallic heat exchanger, said first longitudinal edge of the second at least partially metallic heat exchanger extending adjacent to the second metallic pipe, while the said second longitudinal edge of the second at least partially metallic heat exchanger extends adjacent to the third metallic pipe element, said second at least partially metallic heat exchanger having an external side adapted to be in contact with said second fluid [F2] and defining an inner chamber communicating with the said second metallic pipe and the said third metallic pipe element, allowing the first fluid [F1] to flow through said inner chamber of said second at least partially metallic heat exchanger according to a flow selected from the group consisting of a first flow for directing the first fluid [F1] from said second metallic pipe towards said third metallic pipe element through at least a first portion of the said inner chamber of said second at least partially metallic heat exchanger, a second flow for directing the first fluid [F1] from said third metallic pipe element towards said second metallic pipe through at least a second portion of the said inner chamber of said second at least partially metallic heat exchanger, and combinations thereof, whereby each of said cooling unit forming an integral assembly adapted to be moved and mounted on the supporting structure is adapted to ensure:

(i) that the first at least partially metallic heat exchanger is suspended to one metallic suspension pipe bearing on the supporting structure, said one metallic suspension pipe of the first at least partially metallic heat exchanger being selected from the group consisting of the first metallic pipe and the third metallic pipe element respectively along the first longitudinal edge and along the second longitudinal edge of the said first at least partially metallic heat exchanger, whereby the said first at least partially metallic heat exchanger is suspended at a level below the said one metallic suspension pipe of the first at least partially metallic heat exchanger and is capable of being submitted to an expansion below the said one metallic suspension pipe of the first at least partially metallic heat exchanger selected among the group consisting of substantially free elongation, substantially free expansion curvature and combinations thereof, and (ii) that the second at least partially metallic heat exchanger is suspended to one metallic suspension pipe bearing on the supporting structure, said one metallic suspension pipe of the second at least partially metallic heat exchanger being selected from the group consisting of the second metallic pipe and the third metallic pipe element respectively along the first longitudinal edge and along the second longitudinal edge of the said second at least partially metallic heat exchanger, whereby the said second at least partially metallic heat exchanger is suspended at a level below the said one metallic suspension pipe of the second at least partially metallic heat exchanger and is capable of being submitted to an expansion below the said one metallic suspension pipe of the second at least partially metallic heat exchanger, said expansion being selected among the group consisting of substantially free elongation, substantially free expansion curvature and combinations thereof;

whereby the first at least partially metallic heat exchanger has a weight generating a traction force on the said one metallic suspension pipe selected from the group consisting of the first metallic pipe and the third metallic pipe element, the said first at least partially metallic heat exchanger being attached to the said one metallic suspension pipe selected from the group consisting of the first metallic pipe and the third metallic pipe element by at least an element able to bear at least substantially totally the traction force generated by the weight of the first at least partially metallic heat exchanger, and whereby the second at least partially metallic heat exchanger has a weight generating a traction force on the said one metallic suspension pipe selected from the group consisting of the second metallic pipe and the third metallic pipe element, the said second at least partially metallic heat exchanger being attached to the said one metallic suspension pipe selected from the group consisting of the second metallic pipe and the third metallic pipe element by at least an element means able to bear at least substantially totally the traction force generated by the weight of the second at least partially metallic heat exchanger, in which several units of the said at least one series of cooling units have each (i) a first metallic suspension pipe which is provided at its two opposite ends respectively with a first connection element and a second connection element, and second metallic suspension pipe which is provided at its opposite ends respectively with a third connection element and a fourth connection element, whereby the supporting structure is comprising a series of substantially vertical supporting pipes, and whereby, for each of said several units, each connection element selected among the group consisting of said first connection element, second connection element, third connection element and fourth connection element, is respectively associated to a substantially vertical supporting pipe of said series of substantially vertical supporting pipes.

14. The installation of claim 13, in which the supporting structure comprises at least a series of substantially vertical pipes associated, in their upper section, with an element connecting with at least one metallic suspension pipe of several cooling units of the said at least one series of cooling units.

15. The installation of claim 14, in which the said substantially vertical pipe are serving as part of the supporting structure for supporting units of the said at least one series of cooling units.

16. The installation of claim 13, which is at least partly dismountable form, whereby at least one element selected from the group consisting of the cooling units of the said series, platforms with fan bearing on metallic suspension pipes of cooling units of the said series, fans bearing on platforms bearing on metallic suspension pipes of cooling units of the said series can be removed from the installation.

17. The installation of claim 13, in which the cooling units of the said series of cooling units have each the heat exchangers located at a level above a predetermined level for each considered cooling unit of the said series of cooling units, in which the installation further comprise (i) a supply network with supply pipes for the first fluid to the be condensed, said supply network being located for each cooling unit of said cooling units of the said series under the said predetermined level for the cooling unit in consideration, (ii) a series of substantially vertical supply pipes connected to metallic suspension pipes of the cooling units of said series, and (iii) a collecting network to collect the at least partially condensed first fluid flowing out of the heat exchangers of the cooling units of the said series.

18. The installation of claim 17, in which the said substantially vertical supply pipes have each an outer face, and in which at least some of the said substantially vertical supply pipes are provided along their outer face with at least one reinforcing elements selected from the group consisting of substantially vertical reinforcements, substantially horizontal reinforcements, and combinations thereof.

19. The installation of claim 17, in which the said substantially vertical supply pipes have each an inner face, and in which at least some of the said substantially vertical supply pipes are provided along their outer face with at least one reinforcing elements selected from the group consisting of substantially vertical reinforcements, substantially horizontal reinforcements, and combinations thereof.

20. The installation of claim 13, in which for the cooling units of the said series of cooling units, the first at least partially metallic heat exchanger having its inner chamber filled with 5% to 30% in volume by the liquid medium issued from the condensation of said at least partly condensable vapour and with 70% to 95% in volume by the at least partly condensable vapour has a weight generating a traction force on the said one metallic suspension pipe selected from the group consisting of the first metallic pipe and the third metallic pipe element, the said first at least partially metallic heat exchanger being attached to the said one metallic suspension pipe selected from the group consisting of the first metallic pipe and the third metallic pipe by at least an element able to bear at least substantially totally at least 1.1 times the traction force generated by the weight of the first at least partially metallic heat exchanger having its inner chamber filled with 5% to 30% in volume by the liquid medium issued from the condensation of said at least partly condensable vapour and with 70% to 95% in volume by the at least partly condensable vapour, and whereby the second at least partially metallic heat exchanger having its inner chamber filled with 5% to at most 30% in volume by the liquid medium issued from the condensation of said at least partly condensable vapour and with 70% to 95% in volume by the at least partly condensable vapour has a weight generating a traction force on the said one metallic suspension pipe selected from the group consisting of the second metallic pipe and the third metallic pipe element, the said second at least partially metallic heat exchanger being attached to the said one metallic suspension pipe selected from the group consisting of the second metallic pipe and the third metallic pipe element by at least an element able to bear at least substantially totally at least 1.1 times the traction force generated by the weight of the second at least partially metallic heat exchanger having its inner chamber filled with at 5% to 30% in volume by the liquid medium issued from the condensation of said at least partly condensable vapour and with 70% to 95% in volume by the at least partly condensable vapour.

21. The installation of claim 13, in which for the cooling units of the said series of cooling units, the cooling unit further comprises at least two distinct control spacing elements extending between the first metallic pipe and the second metallic pipe for ensuring the first metallic pipe to be distant from the second metallic pipe by a distance comprised between a minimum distance and a maximum distance.

22. The installation of claim 13, in which at least one metallic suspension pipe of a first cooling unit of the said series of cooling units is connected to at least one metallic suspension pipe of a second cooling unit of the said series of cooling units different from the first, by a connection system selected from the group consisting of a mobile connection system which has at least a portion mobile with respect to the metallic suspension pipe considered, an extensible connection system which has at least a portion extensible with respect to the metallic suspension pipe considered, and combination thereof.

23. The installation of claim 22, in which the said substantially vertical pipe are serving as part of the supporting structure for supporting units of the said at least one series of cooling units.

24. The installation of claim 13, in which for the cooling units of the said series of cooling units, a median plane is defined between the first central axis and the second central axis, and goes through said third central axis, in which the unit extends between a first lateral end and a second lateral end opposite to said first lateral end, whereby the cooling units of the said series of cooling units have each a centre of gravity extending substantially in the said median plane, said centre of gravity located between the said first lateral end and the said second lateral end being offset relative to the said first lateral end and the said second lateral end.

25. The installation of claim 13, in which, for at least some cooling units of the said series of cooling units, at least one pipe selected from the group consisting of the first metallic pipe, the second metallic pipe and the third metallic pipe element is associated with a valve for connecting said pipe to another pipe.

26. An installation for the cooling and at least partial condensing a first at least partly condensable fluid by a second fluid not in direct contact with the first at least partly condensable fluid, said installation comprising a supporting structure designed to carry at least one series of cooling units for the cooling and the at least partial condensing, as well at least partial condensation of the said first at least partly condensable fluid, whereby said at least one series of cooling units are connected between them and to a feeding system for the feeding of the first at least partly condensable fluid to said at least one series of cooling units, whereby the units of said at least one series of cooling units are each a cooling unit forming an integral assembly adapted to be moved and mounted on the supporting structure, said cooling unit comprising at least:

one first metallic pipe with a first central axis, one second metallic pipe with a second central axis substantially parallel to said first central axis one third metallic pipe element selected among the group consisting of a simple metallic pipe and a multiple metallic pipe element, said third metallic pipe element having a third central axis substantially parallel to said first central axis and to said second central axis, said third metallic pipe element being distant from the first pipe and the second pipe by a distance of at least 2 meters, one first at least partially metallic heat exchanger having a first longitudinal edge and a second longitudinal edge opposite to said first longitudinal edge and being distant from said first longitudinal edge of said first at least partially metallic heat exchanger, said first longitudinal edge of said first at least partially metallic heat exchanger extending adjacent to the first pipe, while the said second longitudinal edge of said first at least partially metallic heat exchanger extends adjacent to the third metallic pipe element, said first at least partially metallic heat exchanger having an external side adapted to be in contact with said second fluid [F2] and defining an inner chamber communicating with said first metallic pipe and said third metallic pipe element, allowing the first fluid [F1] to flow through said inner chamber of said first at least partially metallic heat exchanger for directing the first fluid according to a flow selected from the group consisting of a first flow for directing the first fluid from said first metallic pipe towards said third metallic pipe element through at least a first portion of the said inner chamber of said first at least partially metallic heat exchanger, a second flow for directing the first fluid from said third metallic pipe element towards said first metallic pipe through at least a second portion of the said inner chamber of said first at least partially metallic heat exchanger, and combinations thereof, one second at least partially metallic heat exchanger having a first longitudinal edge and a second longitudinal edge opposite to the said first longitudinal edge of the second at least partially metallic heat exchanger, said first longitudinal edge of the second at least partially metallic heat exchanger extending adjacent to the second metallic pipe, while the said second longitudinal edge of the second at least partially metallic heat exchanger extends adjacent to the third metallic pipe element, said second at least partially metallic heat exchanger having an external side adapted to be in contact with said second fluid [F2] and defining an inner chamber communicating with the said second metallic pipe and the said third metallic pipe element, allowing the first fluid [F1] to flow through said inner chamber of said second at least partially metallic heat exchanger according to a flow selected from the group consisting of a first flow for directing the first fluid [F1] from said second metallic pipe towards said third metallic pipe element through at least a first portion of the said inner chamber of said second at least partially metallic heat exchanger, a second flow for directing the first fluid [F1] from said third metallic pipe element towards said second metallic pipe through at least a second portion of the said inner chamber of said second at least partially metallic heat exchanger, and combinations thereof, whereby each of said cooling unit forming an integral assembly adapted to be moved and mounted on the supporting structure is adapted to ensure:

(i) that the first at least partially metallic heat exchanger is suspended to one metallic suspension pipe bearing on the supporting structure, said one metallic suspension pipe of the first at least partially metallic heat exchanger being selected from the group consisting of the first metallic pipe and the third metallic pipe element respectively along the first longitudinal edge and along the second longitudinal edge of the said first at least partially metallic heat exchanger, whereby the said first at least partially metallic heat exchanger is suspended at a level below the said one metallic suspension pipe of the first at least partially metallic heat exchanger and is capable of being submitted to an expansion below the said one metallic suspension pipe of the first at least partially metallic heat exchanger selected among the group consisting of substantially free elongation, substantially free expansion curvature and combinations thereof, and (ii) that the second at least partially metallic heat exchanger is suspended to one metallic suspension pipe bearing on the supporting structure, said one metallic suspension pipe of the second at least partially metallic heat exchanger being selected from the group consisting of the second metallic pipe and the third metallic pipe element respectively along the first longitudinal edge and along the second longitudinal edge of the said second at least partially metallic heat exchanger, whereby the said second at least partially metallic heat exchanger is suspended at a level below the said one metallic suspension pipe of the second at least partially metallic heat exchanger and is capable of being submitted to an expansion below the said one metallic suspension pipe of the second at least partially metallic heat exchanger, said expansion being selected among the group consisting of substantially free elongation, substantially free expansion curvature and combinations thereof;

whereby the first at least partially metallic heat exchanger has a weight generating a traction force on the said one metallic suspension pipe selected from the group consisting of the first metallic pipe and the third metallic pipe element, the said first at least partially metallic heat exchanger being attached to the said one metallic suspension pipe selected from the group consisting of the first metallic pipe and the third metallic pipe element by at least an element able to bear at least substantially totally the traction force generated by the weight of the first at least partially metallic heat exchanger, and whereby the second at least partially metallic heat exchanger has a weight generating a traction force on the said one metallic suspension pipe selected from the group consisting of the second metallic pipe and the third metallic pipe element, the said second at least partially metallic heat exchanger being attached to the said one metallic suspension pipe selected from the group consisting of the second metallic pipe and the third metallic pipe element by at least an element means able to bear at least substantially totally the traction force generated by the weight of the second at least partially metallic heat exchanger, whereby said installation comprises a series of platforms associated with at least one fan, said platforms each bearing on at least (i) a first metallic suspension pipe of one cooling unit of the said series of cooling unit, and (ii) a second metallic suspension pipe distant from the first metallic suspension pipe, said second metallic suspension pipe being selected from another metallic suspension pipe of the said one cooling unit in consideration and a metallic suspension pipe of a cooling unit of the said series different from the said one metallic suspension pipe of the cooling unit in consideration.

27. The installation of claim 26, in which the fan associated to a platform is selected from the group consisting of fans generating an induced air draw contacting at least one heat exchanger of at least one cooling unit of the said series of cooling units, and fans generating a forced air draw contacting at least one heat exchanger of at least one cooling unit of the said series of cooling units.

28. The installation of claim 26, in which the supporting structure comprises at least a series of substantially vertical pipes associated, in their upper section, with an element connecting with at least one metallic suspension pipe of several cooling units of the said at least one series of cooling units.

29. The installation of claim 26, which is at least partly dismountable form, whereby at least one element selected from the group consisting of the cooling units of the said series, platforms with fan bearing on metallic suspension pipes of cooling units of the said series, fans bearing on platforms bearing on metallic suspension pipes of cooling units of the said series can be removed from the installation.

30. The installation of claim 26, in which the cooling units of the said series of cooling units have each the heat exchangers located at a level above a predetermined level for each considered cooling unit of the said series of cooling units, in which the installation further comprise (i) a supply network with supply pipes for the first fluid to the be condensed, said supply network being located for each cooling unit of said cooling units of the said series under the said predetermined level for the cooling unit in consideration, (ii) a series of substantially vertical supply pipes connected to metallic suspension pipes of the cooling units of said series, and (iii) a collecting network to collect the at least partially condensed first fluid flowing out of the heat exchangers of the cooling units of the said series.

31. The installation of claim 30, in which the said substantially vertical supply pipes have each an outer face, and in which at least some of the said substantially vertical supply pipes are provided along their outer face with at least one reinforcing elements selected from the group consisting of substantially vertical reinforcements, substantially horizontal reinforcements, and combinations thereof.

32. The installation of claim 30, in which the said substantially vertical supply pipes have each an inner face, and in which at least some of the said substantially vertical supply pipes are provided along their outer face with at least one reinforcing elements selected from the group consisting of substantially vertical reinforcements, substantially horizontal reinforcements, and combinations thereof.

33. The installation of claim 26, in which for the cooling units of the said series of cooling units, the first at least partially metallic heat exchanger having its inner chamber filled with 5% to 30% in volume by the liquid medium issued from the condensation of said at least partly condensable vapour and with 70% to 95% in volume by the at least partly condensable vapour has a weight generating a traction force on the said one metallic suspension pipe selected from the group consisting of the first metallic pipe and the third metallic pipe element, the said first at least partially metallic heat exchanger being attached to the said one metallic suspension pipe selected from the group consisting of the first metallic pipe and the third metallic pipe element by at least an element able to bear at least substantially totally at least 1.1 times the traction force generated by the weight of the first at least partially metallic heat exchanger having its inner chamber filled with 5% to 30% in volume by the liquid medium issued from the condensation of said at least partly condensable vapour and with 70% to 95% in volume by the at least partly condensable vapour, and whereby the second at least partially metallic heat exchanger having its inner chamber filled with 5% to at most 30% in volume by the liquid medium issued from the condensation of said at least partly condensable vapour and with 70% to 95% in volume by the at least partly condensable vapour has a weight generating a traction force on the said one metallic suspension pipe selected from the group consisting of the second metallic pipe and the third metallic pipe element, the said second at least partially metallic heat exchanger being attached to the said one metallic suspension pipe selected from the group consisting of the second metallic pipe and the third metallic pipe element by at least an element able to bear at least substantially totally at least 1.1 times the traction force generated by the weight of the second at least partially metallic heat exchanger having its inner chamber filled with at 5% to 30% in volume by the liquid medium issued from the condensation of said at least partly condensable vapour and with 70% to 95% in volume by the at least partly condensable vapour.

34. The installation of claim 26, in which for the cooling units of the said series of cooling units, the cooling unit further comprises at least two distinct control spacing elements extending between the first metallic pipe and the second metallic pipe for ensuring the first metallic pipe to be distant from the second metallic pipe by a distance comprised between a minimum distance and a maximum distance.

35. The installation of claim 26, in which at least one metallic suspension pipe of a first cooling unit of the said series of cooling units is connected to at least one metallic suspension pipe of a second cooling unit of the said series of cooling units different from the first, by a connection system selected from the group consisting of a mobile connection system which has at least a portion mobile with respect to the metallic suspension pipe considered, an extensible connection system which has at least a portion extensible with respect to the metallic suspension pipe considered, and combination thereof.

36. The installation of claim 26, in which for the cooling units of the said series of cooling units, a median plane is defined between the first central axis and the second central axis, and goes through said third central axis, in which the unit extends between a first lateral end and a second lateral end opposite to said first lateral end, whereby the cooling units of the said series of cooling units have each a centre of gravity extending substantially in the said median plane, said centre of gravity located between the said first lateral end and the said second lateral end being offset relative to the said first lateral end and the said second lateral end.

37. The installation of claim 26, in which, for at least some cooling units of the said series of cooling units, at least one pipe selected from the group consisting of the first metallic pipe, the second metallic pipe and the third metallic pipe element is associated with a valve for connecting said pipe to another pipe.

* * * * *